US010358622B2

(12) United States Patent
Stokes et al.

(10) Patent No.: US 10,358,622 B2
(45) **Date of Patent: *Jul. 23, 2019**

(54) TWO STEP METHOD OF CLEANING, SANITIZING, AND RINSING A SURFACE

(71) Applicant: ECOLAB USA INC., Saint Paul, MN (US)

(72) Inventors: Jennifer Stokes, Saint Paul, MN (US); Carter M. Silvernail, Saint Paul, MN (US); Erik C. Olson, Saint Paul, MN (US); Steven J. Lange, Saint Paul, MN (US); Junzhong Li, Saint Paul, MN (US); Xin Sun, Saint Paul, MN (US); Allison Brewster, Saint Paul, MN (US); Richard Staub, Saint Paul, MN (US)

(73) Assignee: Ecolab USA Inc., Saint Paul, MN (US)

( * ) Notice: Subject to any disclaimer, the term of this patent is extended or adjusted under 35 U.S.C. 154(b) by 69 days.

This patent is subject to a terminal disclaimer.

(21) Appl. No.: 15/660,469

(22) Filed: Jul. 26, 2017

(65) Prior Publication Data

US 2017/0321165 A1 Nov. 9, 2017

Related U.S. Application Data

(63) Continuation of application No. 14/268,598, filed on May 2, 2014, now Pat. No. 9,752,105, which is a continuation-in-part of application No. 13/965,339, filed on Aug. 13, 2013, now Pat. No. 9,023,784, and a continuation-in-part of application No. 13/863,001, filed on Apr. 15, 2013, said application No. 13/965,339 is a continuation-in-part of application No. 13/614,020, filed on Sep. 13, 2012, now Pat. No. 8,871,699.

(51) Int. Cl.

| | |
|---|---|
| ***C11D 3/48*** | (2006.01) |
| ***C11D 3/04*** | (2006.01) |
| ***C11D 3/08*** | (2006.01) |
| ***C11D 3/10*** | (2006.01) |
| ***C11D 3/36*** | (2006.01) |
| ***C11D 3/39*** | (2006.01) |
| ***C11D 11/00*** | (2006.01) |

(52) U.S. Cl.

CPC ..... *C11D 3/48* (2013.01); *C11D 3/044* (2013.01); *C11D 3/08* (2013.01); *C11D 3/10* (2013.01); *C11D 3/365* (2013.01); *C11D 3/3947* (2013.01); *C11D 11/0064* (2013.01)

(58) Field of Classification Search

CPC .. C11D 3/08; C11D 3/10; C11D 3/365; C11D 3/3947; C11D 3/48; C11D 11/0064; C11D 11/044

See application file for complete search history.

(56) References Cited

U.S. PATENT DOCUMENTS

| | | | |
|---|---|---|---|
| 349,852 | A | 9/1886 | Marchand |
| 1,772,975 | A | 8/1930 | Wieland |
| 2,012,021 | A | 8/1932 | Petersen |
| 2,466,663 | A | 4/1949 | Russ |
| 2,512,640 | A | 6/1950 | Greenspan |
| 2,592,884 | A | 4/1952 | Fox et al. |
| 2,592,885 | A | 4/1952 | Fox et al. |
| 2,592,886 | A | 4/1952 | Fox et al. |
| 2,833,813 | A | 5/1958 | Wallace |
| 3,044,092 | A | 7/1962 | Fox et al. |
| 3,122,417 | A | 2/1964 | Blaser |
| 3,146,718 | A | 9/1964 | Fox et al. |
| 3,248,281 | A | 4/1966 | Goodenough |
| 3,272,899 | A | 9/1966 | Diamond et al. |
| 3,297,456 | A | 1/1967 | Newell |
| 3,329,615 | A | 7/1967 | Cooper |
| 3,350,265 | A | 10/1967 | Rubinstein |
| 3,370,597 | A | 2/1968 | Fox |
| 3,444,242 | A | 5/1969 | Rue |
| 3,514,278 | A | 5/1970 | Brink, Jr. |
| 3,580,850 | A | 5/1971 | Dupre |
| 3,592,774 | A | 7/1971 | Altenschopfer |
| 3,620,786 | A | 11/1971 | Hatch |
| 3,625,901 | A | 12/1971 | Rue |
| 3,650,965 | A | 3/1972 | Cantor |
| 3,858,854 | A | 1/1975 | Win et al. |

(Continued)

FOREIGN PATENT DOCUMENTS

| | | |
|---|---|---|
| AU | 199911969 B2 | 4/1999 |
| AU | 200185520 A1 | 1/2002 |

(Continued)

OTHER PUBLICATIONS

US 7,851,571 B2, 12/2010, Rodrigues et al. (withdrawn)

European Patent Office, "Extended Search Report", issued in connection to European Application No. 13837225.5, dated May 13, 2016, 7 pages.

CN101228192—Kraton Polymers—English Translation May 25, 2011.

CN102844125—Ecolab USA Inc.—English Translation Dec. 26, 2012.

DE19906660—Haka Kunz GmbH—English Translation Jan. 27, 2000.

(Continued)

*Primary Examiner* — Timothy C Cleveland

(74) *Attorney, Agent, or Firm* — McKee, Voorhees & Sease, PLC

(57) ABSTRACT

Methods employing detergent compositions comprising phosphinosuccinic acid oligomers (PSO) in combination with a sanitizing rinse aid are disclosed. The methods beneficially clean, sanitize and rinse a surface in an efficient two-step process. The detergent compositions employ phosphinosuccinic acid adducts, namely mono-, bis- and oligomeric phosphinosuccinic acid (PSO) derivatives, in combination with an alkalinity source and optionally polymers and/or surfactants. The sanitizing and rinsing compositions employ peroxycarboxylic acid compositions in combination with a nonionic defoaming and wetting surfactant.

20 Claims, No Drawings

(56) References Cited

U.S. PATENT DOCUMENTS 3,867,300 A 2/1975 Karabinos et al.
3,874,927 A 4/1975 Willard, Sr.
3,890,350 A 6/1975 Weber et al.
3,895,116 A 7/1975 Hefting et al.
3,908,680 A 9/1975 Krezanoski
3,910,880 A 10/1975 Lamberti
3,915,633 A 10/1975 Ramachandran
3,929,678 A 12/1975 Laughlin et al.
3,941,713 A 3/1976 Dawson et al.
3,944,497 A 3/1976 Alterman et al.
3,959,168 A 5/1976 Germscheid et al.
3,960,781 A 6/1976 Freis et al.
3,996,386 A 12/1976 Malkki et al.
4,002,775 A 1/1977 Kabara
4,005,024 A 1/1977 Rodriguez et al.
4,011,346 A 3/1977 Ernst
4,024,257 A 5/1977 Kibbel, Jr.
4,041,149 A 8/1977 Gaffar et al.
4,051,058 A 9/1977 Bowing et al.
4,051,059 A 9/1977 Bowing et al.
4,094,953 A 6/1978 Hadi et al.
4,129,517 A 12/1978 Eggensperger et al.
4,136,052 A 1/1979 Mazzola
4,147,559 A 4/1979 Fraula et al.
4,162,987 A 7/1979 Maguire, Jr. et al.
4,187,121 A 2/1980 Herold et al.
4,190,551 A 2/1980 Murata et al.
4,191,660 A 3/1980 Schreiber et al.
4,203,756 A 5/1980 Claeys et al.
4,219,435 A 8/1980 Biard et al.
4,219,436 A 8/1980 Gromer et al.
4,244,884 A 1/1981 Hutchins et al.
RE30,537 E 3/1981 Fraula et al.
4,253,842 A 3/1981 Ehrlich
4,285,352 A 8/1981 McMahon et al.
4,289,728 A 9/1981 Peel et al.
4,321,157 A 3/1982 Harris et al.
4,370,199 A 1/1983 Orndorff
4,376,787 A 3/1983 Lentsch et al.
4,404,040 A 9/1983 Wang
4,406,884 A 9/1983 Fawzi et al.
4,410,442 A 10/1983 Lucas et al.
4,411,810 A 10/1983 Dutton et al.
4,430,381 A 2/1984 Harvey et al.
4,460,490 A 7/1984 Barford et al.
4,477,438 A 10/1984 Willcockson et al.
4,478,683 A 10/1984 Orndorff
4,501,681 A 2/1985 Grouit et al.
4,517,166 A 5/1985 Busacca
4,521,375 A 6/1985 Houlsby
4,529,534 A 7/1985 Richardson
4,534,945 A 8/1985 Hopkins et al.
4,536,313 A 8/1985 Hignett et al.
4,545,917 A 10/1985 Smith et al.
4,557,898 A 12/1985 Greene et al.
4,557,935 A 12/1985 af Ekenstam et al.
4,566,980 A 1/1986 Smith
4,591,565 A 5/1986 Branner-Jorgensen et al.
4,592,488 A 6/1986 Simon et al.
4,594,175 A 6/1986 Copeland
4,595,520 A 6/1986 Heile et al.
4,613,452 A 9/1986 Sanderson
4,618,444 A 10/1986 Hudson et al.
4,624,713 A 11/1986 Morganson et al.
4,632,741 A 12/1986 Wolf et al.
4,647,458 A 3/1987 Ueno et al.
4,655,781 A 4/1987 Hsieh et al.
4,659,494 A 4/1987 Soldanski et al.
4,666,622 A 5/1987 Martin et al.
4,671,891 A 6/1987 Hartman
4,680,134 A 7/1987 Heile et al.
4,681,914 A 7/1987 Olson et al.
4,683,618 A 8/1987 O'Brien
4,692,335 A 9/1987 Iwanski
4,695,290 A 9/1987 Kindig et al.
4,704,404 A 11/1987 Sanderson
4,711,738 A 12/1987 Copeland
4,715,980 A 12/1987 Lopes et al.
4,731,195 A 3/1988 Olson
4,732,694 A 3/1988 Gowland et al.
4,738,840 A 4/1988 Simon et al.
4,740,308 A 4/1988 Fremont et al.
4,743,447 A 5/1988 Le Riouzic et al.
4,753,033 A 6/1988 Kindig
4,756,844 A 7/1988 Walles et al.
4,762,637 A 8/1988 Aronson et al.
4,772,290 A 9/1988 Mitchell et al.
4,776,974 A 10/1988 Stanton et al.
4,783,278 A 11/1988 Sanderson et al.
4,793,942 A 12/1988 Lokkesmoe et al.
4,802,994 A 2/1989 Mouche et al.
4,830,766 A 5/1989 Gallup et al.
4,830,773 A 5/1989 Olson
4,834,900 A 5/1989 Soldanski et al.
4,846,993 A 7/1989 Lentsch et al.
4,863,632 A 9/1989 Aronson et al.
4,865,752 A 9/1989 Jacobs
4,900,721 A 2/1990 Bansemir et al.
4,906,617 A 3/1990 Jacquet et al.
4,908,306 A 3/1990 Lorinez
4,917,815 A 4/1990 Beilfuss et al.
4,919,841 A 4/1990 Kamel et al.
4,920,100 A 4/1990 Lehmann et al.
4,923,677 A 5/1990 Simon et al.
4,933,102 A 6/1990 Olson
4,937,066 A 6/1990 Vlock
4,943,414 A 7/1990 Jacobs et al.
4,945,100 A 7/1990 Nyfeler et al.
4,986,963 A 1/1991 Corcoran et al.
4,996,062 A 2/1991 Lehtonen et al.
4,997,571 A 3/1991 Roensch et al.
4,997,625 A 3/1991 Simon et al.
5,004,760 A 4/1991 Patton et al.
5,010,109 A 4/1991 Inoi
5,013,560 A 5/1991 Stentz et al.
5,015,408 A 5/1991 Reuss
5,017,617 A 5/1991 Kihara et al.
5,018,577 A 5/1991 Pardue et al.
5,021,096 A 6/1991 Abadi
5,023,000 A 6/1991 Kneller et al.
5,030,240 A 7/1991 Wiersema et al.
5,043,176 A 8/1991 Bycroft et al.
5,069,286 A 12/1991 Roensch et al.
5,078,896 A 1/1992 Rorig et al.
5,084,239 A 1/1992 Moulton et al.
5,085,794 A 2/1992 Kneller et al.
5,093,140 A 3/1992 Watanabe
5,114,178 A 5/1992 Baxter
5,122,538 A 6/1992 Lokkesmoe et al.
5,129,824 A 7/1992 Keller
5,130,124 A 7/1992 Merianos et al.
5,139,788 A 8/1992 Schmidt
5,168,655 A 12/1992 Davidson et al.
5,176,899 A 1/1993 Montgomery
5,184,471 A 2/1993 Losacco et al.
5,200,189 A 4/1993 Oakes et al.
5,208,057 A 5/1993 Greenley et al.
5,234,703 A 8/1993 Guthery
5,234,719 A 8/1993 Richter et al.
5,246,620 A 9/1993 Gethoffer et al.
5,266,587 A 11/1993 Sankey et al.
5,268,003 A 12/1993 Coope et al.
5,269,962 A 12/1993 Brodbeck et al.
5,279,757 A 1/1994 Gethoffer et al.
5,288,331 A 2/1994 Rings et al.
5,292,447 A 3/1994 Venturello et al.
5,306,350 A 4/1994 Hoy et al.
5,314,687 A 5/1994 Oakes et al.
5,320,805 A 6/1994 Kramer et al.
5,330,769 A 7/1994 McKinzie et al.
5,336,500 A 8/1994 Richter et al.
5,344,652 A 9/1994 Hall, II et al.
5,358,653 A 10/1994 Gladfelter et al.
5,364,650 A 11/1994 Guthery

(56) References Cited

U.S. PATENT DOCUMENTS 5,368,867 A 11/1994 Da Silva et al.
5,385,680 A 1/1995 Didier et al.
5,391,324 A 2/1995 Reinhardt et al.
5,409,633 A 4/1995 Clements et al.
5,409,713 A 4/1995 Lokkesmoe et al.
5,419,908 A 5/1995 Richter et al.
5,422,028 A 6/1995 Oakes et al.
5,429,769 A 7/1995 Nicholson et al.
5,435,808 A 7/1995 Holzhauer et al.
5,436,008 A 7/1995 Richter et al.
5,437,868 A 8/1995 Oakes et al.
5,451,346 A 9/1995 Amou et al.
5,454,982 A 10/1995 Murch et al.
5,463,112 A 10/1995 Sankey et al.
5,466,825 A 11/1995 Carr et al.
5,481,084 A 1/1996 Patrick et al.
5,489,434 A 2/1996 Oakes et al.
5,489,706 A 2/1996 Revell
5,494,588 A 2/1996 LaZonby
5,501,814 A 3/1996 Engelskirchen et al.
5,508,046 A 4/1996 Cosentino et al.
5,512,309 A 4/1996 Bender et al.
5,527,898 A 6/1996 Bauer et al.
5,545,343 A 8/1996 Brougham et al.
5,545,374 A 8/1996 French et al.
5,567,444 A 10/1996 Hei et al.
5,576,282 A 11/1996 Miracle et al.
5,578,134 A 11/1996 Lentsch et al.
5,591,706 A 1/1997 Pioumen
5,597,790 A 1/1997 Thoen
5,616,281 A 4/1997 Hardy et al.
5,616,335 A 4/1997 Nicolle et al.
5,616,616 A 4/1997 Hall, II et al.
5,622,708 A 4/1997 Richter et al.
5,624,634 A 4/1997 Brougham et al.
5,632,676 A 5/1997 Kurschner et al.
5,641,530 A 6/1997 Chen
5,656,302 A 8/1997 Cosentino et al.
5,658,467 A 8/1997 LaZonby et al.
5,658,595 A 8/1997 Van Os
5,674,538 A 10/1997 Lokkesmoe et al.
5,674,828 A 10/1997 Knowlton et al.
5,683,724 A 11/1997 Hei et al.
5,686,401 A 11/1997 Willey et al.
5,692,392 A 12/1997 Swier
5,712,239 A 1/1998 Knowlton et al.
5,718,910 A 2/1998 Oakes et al.
5,720,983 A 2/1998 Malone
5,725,678 A 3/1998 Cannon et al.
5,741,767 A 4/1998 Nicholson et al.
5,756,139 A 5/1998 Harvey et al.
5,785,867 A 7/1998 LaZonby et al.
5,817,614 A 10/1998 Miracle et al.
5,840,343 A 11/1998 Hall, II et al.
5,851,483 A 12/1998 Nicolle et al.
5,866,005 A 2/1999 DeSimone et al.
5,891,392 A 4/1999 Monticello et al.
5,900,256 A 5/1999 Scoville, Jr. et al.
5,902,619 A 5/1999 Rubow et al.
5,914,303 A 6/1999 Sankey et al.
5,928,382 A 7/1999 Reinhardt et al.
5,954,851 A 9/1999 Sakae
5,958,864 A 9/1999 Artiga Gonzalez et al.
5,968,539 A 10/1999 Beerse et al.
5,968,881 A 10/1999 Haeggberg et al.
5,977,053 A 11/1999 Groth et al.
5,989,611 A 11/1999 Stemmler, Jr. et al.
5,993,562 A 11/1999 Roclofs et al.
5,995,967 A 11/1999 Iacobovici et al.
5,998,358 A 12/1999 Herdt et al.
6,008,405 A 12/1999 Gray et al.
6,010,729 A 1/2000 Gutzmann et al.
6,024,986 A 2/2000 Hei
6,028,104 A 2/2000 Schmidt et al.
6,033,705 A 3/2000 Isaacs
6,039,992 A 3/2000 Compadre et al.
6,049,002 A 4/2000 Mattila et al.
6,071,356 A 6/2000 Olsen
6,080,712 A 6/2000 Revel et al.
6,096,226 A 8/2000 Fuchs et al.
6,096,266 A 8/2000 Duroselle
6,096,348 A 8/2000 Miner et al.
6,103,286 A 8/2000 Gutzmann et al.
6,111,963 A 8/2000 Thompson, III
6,113,963 A 9/2000 Gutzmann et al.
6,160,110 A 12/2000 Thomaides et al.
6,165,483 A 12/2000 Hei et al.
6,176,971 B1 1/2001 Sun Yu et al.
6,183,807 B1 2/2001 Gutzmann et al.
6,194,367 B1 2/2001 Talley
6,197,739 B1 3/2001 Oakes et al.
6,204,234 B1 3/2001 Herbots et al.
6,204,238 B1 3/2001 Oftring et al.
6,221,323 B1 4/2001 Mizuno et al.
6,238,685 B1 5/2001 Hei et al.
6,257,253 B1 7/2001 Lentsch et al.
6,262,013 B1 7/2001 Smith et al.
6,271,190 B1 8/2001 Boskamp et al.
6,274,542 B1 8/2001 Carr et al.
6,277,344 B1 8/2001 Hei et al.
6,302,968 B1 10/2001 Baum et al.
6,303,556 B1 10/2001 Kott et al.
6,306,252 B1 10/2001 Ryham
6,310,025 B1 10/2001 Del Duca et al.
6,326,032 B1 12/2001 Richter et al.
6,342,472 B1 1/2002 Legel et al.
6,380,145 B1 4/2002 Herbots et al.
6,395,703 B2 5/2002 Scepanski
6,417,151 B1 7/2002 Grothus et al.
6,423,868 B1 7/2002 Carr et al.
6,436,445 B1 8/2002 Hei et al.
6,451,746 B1 9/2002 Moore et al.
6,468,955 B1 10/2002 Smets et al.
6,472,199 B1 10/2002 Monken
6,479,454 B1 11/2002 Smith et al.
6,489,281 B1 12/2002 Smith et al.
6,492,316 B1 12/2002 Herbots et al.
6,495,357 B1 12/2002 Fuglsang et al.
6,506,737 B1 1/2003 Hei et al.
6,514,556 B2 2/2003 Hilgren et al.
6,534,075 B1 3/2003 Hei et al.
6,537,958 B1 3/2003 Di Capua et al.
6,541,436 B1 4/2003 Arvanitidou et al.
6,545,047 B2 4/2003 Gutzmann et al.
6,548,467 B2 4/2003 Baker et al.
6,548,470 B1 4/2003 de Buzzaccarini et al.
6,572,789 B1 6/2003 Yang et al.
6,589,565 B1 7/2003 Richter et al.
6,593,283 B2 7/2003 Hei et al.
6,619,051 B1 9/2003 Kilawee et al.
6,624,133 B1 9/2003 McKenzie et al.
6,627,593 B2 9/2003 Hei et al.
6,627,657 B1 9/2003 Hilgren et al.
6,630,439 B1 10/2003 Norwood et al.
6,635,286 B2 10/2003 Hei et al.
6,638,902 B2 10/2003 Tarara et al.
6,674,538 B2 1/2004 Takahashi
6,693,069 B2 2/2004 Korber et al.
6,703,357 B1 3/2004 Maurer et al.
6,718,991 B1 4/2004 Breyer et al.
6,783,767 B2 8/2004 Shroot et al.
6,808,729 B1 10/2004 Roselle et al.
6,828,294 B2 12/2004 Kellar et al.
6,841,090 B1 1/2005 Serego Allighieri et al.
6,855,328 B2 2/2005 Hei et al.
6,866,888 B2 3/2005 Baker et al.
6,897,193 B2 5/2005 Kischkel et al.
6,903,064 B1 6/2005 Kasturi et al.
6,962,714 B2 11/2005 Hei et al.
6,964,787 B2 11/2005 Swart et al.
6,964,943 B1 11/2005 Bettiol et al.
6,982,241 B2 1/2006 Smith et al.
7,008,913 B2 3/2006 Hei et al.
7,056,536 B2 6/2006 Richter et al.

(56) References Cited

U.S. PATENT DOCUMENTS 7,060,301 B2 6/2006 Wei et al.
7,074,749 B2 7/2006 Tropsch et al.
7,129,076 B2 10/2006 Poulose et al.
7,141,125 B2 11/2006 McKechnie et al.
7,150,884 B1 12/2006 Hilgren et al.
7,153,817 B2 12/2006 Binder
7,179,778 B2 2/2007 Weber
7,226,898 B2 6/2007 Bragulla
7,250,159 B1 7/2007 Arnaud
7,320,887 B2 1/2008 Kottwitz et al.
7,323,438 B2 1/2008 Hedges et al.
7,438,767 B2 10/2008 McKechnie et al.
7,448,556 B2 11/2008 Muehlhausen et al.
7,462,375 B2 12/2008 Ge
7,470,655 B2 12/2008 Biering et al.
7,494,963 B2 2/2009 Ahmed et al.
7,498,051 B2 3/2009 Man et al.
7,501,388 B2 3/2009 McClung
7,504,123 B2 3/2009 Man et al.
7,504,124 B2 3/2009 Man et al.
7,507,429 B2 3/2009 Man et al.
7,510,859 B2 3/2009 Wieland et al.
7,517,847 B2 4/2009 Catalfamo et al.
7,611,882 B2 11/2009 Bjornvad et al.
7,659,354 B2 2/2010 Song et al.
7,682,403 B2 3/2010 Gohl et al.
7,727,946 B2 6/2010 Catalfamo et al.
7,749,334 B2 7/2010 Biering et al.
7,754,670 B2 7/2010 Lange et al.
7,754,671 B2 7/2010 Lin et al.
7,816,555 B2 10/2010 Smith et al.
7,887,641 B2 2/2011 Man et al.
7,892,536 B2 2/2011 Kelemen et al.
7,910,647 B2 3/2011 Weide et al.
7,915,212 B2 3/2011 Yeung et al.
7,928,049 B2 4/2011 Wagner et al.
7,939,485 B2 5/2011 Price et al.
7,985,570 B2 7/2011 Wieland et al.
7,994,251 B2 8/2011 Rogmann et al.
8,012,267 B2 9/2011 Jekel et al.
8,022,027 B2 9/2011 Souter et al.
8,043,650 B2 10/2011 Gutzmann et al.
8,058,374 B2 11/2011 Rodrigues et al.
8,063,008 B2 11/2011 Dicosimo et al.
8,110,603 B2 2/2012 Kawabata et al.
8,119,588 B2 2/2012 Bernhardt et al.
8,124,132 B2 2/2012 Hilgren et al.
8,178,352 B2 5/2012 Tokhtuev et al.
8,202,830 B2 6/2012 Miralles et al.
8,222,196 B2 7/2012 Smith et al.
8,246,906 B2 8/2012 Hei et al.
8,247,363 B2 8/2012 Fernholz et al.
8,426,634 B2 4/2013 Neas et al.
8,729,296 B2 5/2014 Fast et al.
8,784,790 B2 7/2014 Myntti et al.
8,871,699 B2 10/2014 Silvernail
8,940,676 B2 1/2015 Catlin et al.
8,999,399 B2 4/2015 Lisowsky et al.
9,018,142 B2 4/2015 Rovison, Jr. et al.
9,034,390 B2 5/2015 Kielbania, Jr.
9,051,285 B2 6/2015 Rohwer et al.
9,321,664 B2 4/2016 Li et al.
9,676,711 B2 6/2017 Junzhong et al.
9,752,105 B2 9/2017 Stokes et al.
2002/0013252 A1 1/2002 Schmiedel et al.
2002/0037824 A1 3/2002 Smets et al.
2002/0082181 A1 6/2002 Humphrey et al.
2002/0086903 A1 7/2002 Giambrone et al.
2002/0128312 A1 9/2002 Hei et al.
2002/0159917 A1 10/2002 Swart et al.
2002/0160930 A1 10/2002 Emmerson et al.
2002/0161258 A1 10/2002 Miracle et al.
2002/0177220 A1 11/2002 Monken
2003/0087786 A1 5/2003 Hei et al.
2003/0139310 A1 7/2003 Smith et al.
2003/0139311 A1 7/2003 Biering et al.
2003/0141258 A1 7/2003 Hatch
2003/0157192 A1 8/2003 Shroot et al.
2003/0166848 A1 9/2003 Kingma et al.
2003/0191040 A1 10/2003 Adriaanse et al.
2003/0194433 A1 10/2003 Hei et al.
2003/0199583 A1 10/2003 Gutzmann et al.
2004/0007255 A1 1/2004 Labib et al.
2004/0029755 A1 2/2004 Bragulla
2004/0146426 A1 7/2004 Biering et al.
2004/0147423 A1 7/2004 Scialla et al.
2004/0194810 A1 10/2004 Strothoff et al.
2004/0259755 A1 12/2004 Orlich et al.
2004/0266639 A1 12/2004 Spindler
2005/0003979 A1 1/2005 Lentsch et al.
2005/0020464 A1 1/2005 Smith et al.
2005/0086757 A1 4/2005 Lann
2005/0137105 A1 6/2005 Griese et al.
2005/0137107 A1 6/2005 Griese et al.
2005/0153859 A1 7/2005 Gohl
2005/0183744 A1 8/2005 Staub et al.
2005/0245411 A1 11/2005 Yang et al.
2005/0282261 A1 12/2005 Sauter et al.
2006/0003028 A1 1/2006 Myers et al.
2006/0042665 A1 3/2006 Fernholz et al.
2006/0046945 A1 3/2006 Herdt et al.
2006/0069003 A1 3/2006 Song et al.
2006/0069004 A1 3/2006 Song et al.
2006/0118141 A1 6/2006 Andriola et al.
2006/0122090 A1 6/2006 Spanier et al.
2006/0134239 A1 6/2006 Weide et al.
2006/0247144 A1 11/2006 Geret
2006/0270580 A1 11/2006 Smith et al.
2007/0020364 A1 1/2007 Burnett et al.
2007/0084650 A1 4/2007 Schwei et al.
2007/0093407 A1 4/2007 Bianchetti et al.
2007/0102030 A1 5/2007 Young
2007/0128129 A1 6/2007 Stehr et al.
2007/0155835 A1 7/2007 Weide et al.
2007/0173428 A1 7/2007 Appleby et al.
2007/0190177 A1 8/2007 Kling et al.
2008/0014284 A1 1/2008 Meyer et al.
2008/0026026 A1 1/2008 Lu et al.
2008/0076692 A1 3/2008 Carvell et al.
2008/0118580 A1 5/2008 Bockmuhl et al.
2008/0121250 A1 5/2008 Fernholz et al.
2008/0169243 A1 7/2008 Dave et al.
2008/0261851 A1 10/2008 Barthel et al.
2008/0263778 A1 10/2008 Baars et al.
2008/0271760 A1 11/2008 Housmekerides et al.
2008/0274930 A1 11/2008 Smith et al.
2009/0061017 A1 3/2009 Pedersen et al.
2009/0145859 A1 6/2009 Man et al.
2009/0288683 A1 11/2009 Cummings et al.
2009/0325841 A1 12/2009 Erickson et al.
2010/0075883 A1 3/2010 Geret et al.
2010/0093587 A1 4/2010 Preuschen et al.
2010/0144958 A1 6/2010 Findlay et al.
2010/0189707 A1 7/2010 Barnett
2010/0330013 A1 12/2010 O'Connell et al.
2011/0165261 A1 7/2011 Derby et al.
2011/0177046 A1 7/2011 Cahill et al.
2011/0182959 A1 7/2011 Cahill et al.
2011/0308553 A1 12/2011 Strothoff et al.
2012/0046216 A1 2/2012 Hodge et al.
2012/0121679 A1 5/2012 Cannon et al.
2012/0128614 A1 5/2012 Reith et al.
2012/0148751 A1 6/2012 Herdt et al.
2012/0164236 A1 6/2012 Iwasa et al.
2012/0165237 A1 6/2012 Silvernail
2012/0208734 A1 8/2012 Eiting et al.
2012/0291820 A1 11/2012 Strothoff et al.
2013/0247308 A1 9/2013 Duerrschmidt et al.

(56) References Cited

U.S. PATENT DOCUMENTS

| | | | |
|---|---|---|---|
| 2014/0308162 | A1 | 10/2014 | Lange |
| 2017/0020130 | A1 | 1/2017 | Buschmann et al. |

FOREIGN PATENT DOCUMENTS

| | | | |
|---|---|---|---|
| CA | 2122136 | A1 | 4/1993 |
| CA | 2163757 | A1 | 12/1994 |
| CA | 2314648 | A1 | 1/2001 |
| CA | 2314660 | A1 | 1/2001 |
| CA | 2448548 | A1 | 12/2002 |
| CA | 2450893 | A1 | 1/2003 |
| CA | 2531098 | A1 | 1/2005 |
| CA | 2567210 | A1 | 2/2006 |
| CN | 101622199 | A | 1/2010 |
| CN | 101228192 | B | 5/2011 |
| CN | 102844125 | A | 12/2012 |
| DE | 4324202 | A1 | 12/1994 |
| DE | 19639603 | A1 | 9/1996 |
| DE | 19754290 | A1 | 6/1999 |
| DE | 19906660 | A1 | 1/2000 |
| DE | 19949980 | A1 | 4/2001 |
| DE | 10127919 | A1 | 12/2002 |
| EP | 0133354 | A1 | 8/1983 |
| EP | 0096566 | A1 | 12/1983 |
| EP | 0256148 | A1 | 2/1988 |
| EP | 0383214 | A2 | 8/1990 |
| EP | 491391 | A1 | 12/1991 |
| EP | 0511091 | A1 | 10/1992 |
| EP | 9612843 | A1 | 8/1994 |
| EP | 0658594 | A1 | 6/1995 |
| EP | 0691398 | A1 | 1/1996 |
| EP | 0609273 | B1 | 6/1996 |
| EP | 0511081 | B1 | 6/1999 |
| EP | 1114137 | B1 | 9/1999 |
| EP | 1129171 | B1 | 11/1999 |
| EP | 0976867 | B1 | 2/2000 |
| EP | 1138335 | A1 | 3/2000 |
| EP | 1063281 | A2 | 12/2000 |
| EP | 1065261 | A2 | 1/2001 |
| EP | 1127939 | A1 | 8/2001 |
| EP | 1260234 | A1 | 4/2002 |
| EP | 1293215 | A1 | 3/2003 |
| EP | 1302108 | A2 | 4/2003 |
| EP | 1477552 | A1 | 11/2004 |
| EP | 1926808 | B1 | 9/2006 |
| EP | 1451243 | B9 | 12/2006 |
| EP | 2471941 | B1 | 5/2007 |
| EP | 2714877 | B1 | 7/2017 |
| EP | 2566943 | B1 | 9/2017 |
| GB | 1222911 | | 5/1968 |
| GB | 1148046 | A | 4/1969 |
| GB | 1351977 | A | 5/1974 |
| GB | 1571357 | | 7/1980 |
| GB | 2427614 | A | 1/2007 |
| IN | 200300222 | | 4/2005 |
| IN | 200000442 | | 4/2007 |
| IN | 200502145 | | 8/2007 |
| IN | 212385 | | 2/2008 |
| IN | 226322 | | 1/2009 |
| IN | 200902559 | | 12/2009 |
| IN | 201205604 | | 3/2014 |
| IN | 201301987 | | 9/2014 |
| IN | 201211025 | | 10/2014 |
| IN | 201401913 | | 3/2015 |
| IN | 201402010 | | 3/2015 |
| JP | 60228683 | A | 11/1985 |
| JP | 6112878 | A | 1/1986 |
| JP | 7330994 | A | 12/1995 |
| JP | 1150096 | A | 2/1999 |
| JP | 1161177 | A | 3/1999 |
| JP | 1161178 | A | 3/1999 |
| JP | 1161179 | A | 3/1999 |
| JP | 1161180 | A | 3/1999 |
| JP | 1161181 | A | 3/1999 |
| JP | 1161183 | A | 3/1999 |
| JP | 1161185 | A | 3/1999 |
| JP | 2001508110 | A | 6/2001 |
| JP | 3370571 | B2 | 11/2002 |
| JP | 2006265469 | A | 10/2006 |
| JP | 2007246432 | A | 9/2007 |
| JP | 2010144087 | A | 7/2010 |
| JP | 4851093 | B2 | 1/2012 |
| JP | 2012507627 | A | 3/2012 |
| JP | 5036962 | B2 | 7/2012 |
| JP | 2013129808 | A | 7/2013 |
| JP | 2013158743 | A | 8/2013 |
| KR | 20060046896 | A | 5/2006 |
| KR | 20080099255 | A | 11/2008 |
| MX | 329088 | A | 3/2015 |
| WO | 199007501 | A1 | 7/1990 |
| WO | 9202309 | A1 | 2/1992 |
| WO | 9407982 | A1 | 4/1994 |
| WO | 199418299 | A1 | 8/1994 |
| WO | 9423000 | A1 | 10/1994 |
| WO | 9504128 | A1 | 2/1995 |
| WO | 199521290 | A1 | 8/1995 |
| WO | 9526392 | A1 | 10/1995 |
| WO | 9526393 | A1 | 10/1995 |
| WO | 9533816 | A1 | 12/1995 |
| WO | 9617920 | A1 | 6/1996 |
| WO | 9722651 | A1 | 6/1997 |
| WO | 199722651 | A1 | 6/1997 |
| WO | 9731999 | A1 | 9/1997 |
| WO | 9804659 | A3 | 2/1998 |
| WO | 9805749 | A1 | 2/1998 |
| WO | 9815607 | A2 | 4/1998 |
| WO | 9815608 | A2 | 4/1998 |
| WO | 9856760 | A1 | 12/1998 |
| WO | 9903962 | A1 | 1/1999 |
| WO | 9910466 | A1 | 3/1999 |
| WO | 9914304 | A1 | 3/1999 |
| WO | 9919449 | A1 | 4/1999 |
| WO | 9920729 | A1 | 4/1999 |
| WO | 199920726 | A1 | 4/1999 |
| WO | 9941350 | A1 | 8/1999 |
| WO | 9941351 | A1 | 8/1999 |
| WO | 0037041 | A1 | 6/2000 |
| WO | 0060042 | A1 | 10/2000 |
| WO | 0061715 | A1 | 10/2000 |
| WO | 0071651 | A2 | 11/2000 |
| WO | 200066810 | A1 | 11/2000 |
| WO | 0102528 | A1 | 1/2001 |
| WO | 0102529 | A1 | 1/2001 |
| WO | 0107551 | A1 | 2/2001 |
| WO | 0107560 | A1 | 2/2001 |
| WO | 0136579 | A1 | 5/2001 |
| WO | 0138471 | A1 | 5/2001 |
| WO | 0146358 | A2 | 6/2001 |
| WO | 0176442 | A1 | 10/2001 |
| WO | 0202725 | A1 | 1/2002 |
| WO | 02079105 | A1 | 10/2002 |
| WO | 03004408 | A1 | 5/2003 |
| WO | 03048291 | A1 | 6/2003 |
| WO | 03073849 | A1 | 9/2003 |
| WO | 2004091557 | A2 | 10/2004 |
| WO | 2005108644 | A2 | 11/2005 |
| WO | 06105841 | A1 | 10/2006 |
| WO | 06105863 | A1 | 10/2006 |
| WO | 06108490 | A1 | 10/2006 |
| WO | 2006121596 | A1 | 11/2006 |
| WO | 07025603 | A1 | 3/2007 |
| WO | 2008028896 | A2 | 3/2008 |
| WO | 2008035071 | A1 | 3/2008 |
| WO | 2008088975 | A1 | 7/2008 |
| WO | 2008137790 | A2 | 11/2008 |
| WO | 2009112992 | A1 | 9/2009 |
| WO | 09122125 | A1 | 10/2009 |
| WO | 2010000636 | A1 | 1/2010 |
| WO | 2010033746 | A1 | 3/2010 |
| WO | 2010033747 | A1 | 3/2010 |
| WO | 10146543 | A1 | 12/2010 |
| WO | 2011014783 | A1 | 2/2011 |
| WO | 2011024094 | A2 | 3/2011 |
| WO | 11070392 | A1 | 6/2011 |

(56) References Cited

FOREIGN PATENT DOCUMENTS

| | | | |
|---|---|---|---|
| WO | 2011089493 | A2 | 7/2011 |
| WO | 2011161459 | A1 | 12/2011 |
| WO | 12014016 | A1 | 2/2012 |
| WO | 12028196 | A1 | 3/2012 |
| WO | 12036702 | A1 | 3/2012 |
| WO | 2012028203 | A1 | 3/2012 |
| WO | 2012042000 | A1 | 4/2012 |
| WO | 12128629 | A1 | 9/2012 |
| WO | 2012155986 | A1 | 11/2012 |
| WO | 2012156369 | A1 | 11/2012 |

OTHER PUBLICATIONS

DE19949980—Henkel KGaA—English Translation Apr. 19, 2001.
DE10127919—Ecolab Gmbh & Co.—English Translation Dec. 19, 2002.
DE4324202—Henkel Ecolab Gmbh & Co.—English Translation Dec. 1, 1994.
JP4851093—Novo Enzyme Akuti Angeles Cub Graphics—English Translation Mar. 23, 2006.
JPS60228683—Mitsubishi Electric—English Translation Nov. 13, 1985.
JP7330994—Nippon Synthetic Chemical Industry—English Translation Dec. 19, 1995.
EP0256148—Jon A. Benckiser—English Translation Feb. 24, 1988.
EP0511081—Roquette Freres—English Translation Oct. 28, 1992.
EP0609273—Henkel Kommanditgesellschaft—English Translation Aug. 10, 1994.
EP0658594—Witco Vinyl Additives GmbH—English Translation Jun. 21, 1995.
WO 01/46358—Henkel Kommanditgeselischaft—English Translation Jun. 28, 2001.
JP2006-265469, Daisan Kogyo KK,—English Translation of the Abstract, Oct. 5, 2006.

TWO STEP METHOD OF CLEANING, SANITIZING, AND RINSING A SURFACE

CROSS REFERENCE TO RELATED APPLICATIONS

This is a continuation application of U.S. application Ser. No. 14/268,598, filed May 2, 2014, which is a continuation-in-part of U.S. application Ser. No. 13/863,001 filed Apr. 15, 2013, titled Peroxycarboxylic Acid Based Sanitizing Rinse Additives for Use in Ware Washing, and is a continuation-in-part of U.S. application Ser. No. 13/965,339 filed Aug. 13, 2013, titled Method of Reducing Soil Redeposition on a Hard Surface Using Phosphinosuccinic Acid Adducts, now U.S. Pat. No. 9,023,784, issued May 5, 2015, which is a continuation-in-part of U.S. application Ser. No. 13/614,020, filed Sep. 13, 2012, titled Detergent Composition Comprising Phosphinosuccinic Acid Adducts and Methods of Use, now U.S. Pat. No. 8,871,699, issued Oct. 28, 2014, each of which are incorporated herein in reference in their entirety.

FIELD OF THE INVENTION

The invention relates to methods for ware wash applications utilizing a detergent composition and sanitizing rinse aid to clean, sanitize and rinse a surface in a two-step process. The detergent compositions employ phosphinosuccinic acid adducts, namely mono-, bis- and oligomeric phosphinosuccinic acid (PSO) derivatives, in combination with an alkalinity source and optionally polymers and/or surfactants. The sanitizing and rinsing compositions employ peroxycarboxylic acid compositions in combination with a nonionic defoaming and wetting surfactant. The sanitizing and rinsing compositions are formulated in a single liquid concentrate, replacing a traditional dual product of a sanitizer and rinse aid.

BACKGROUND OF THE INVENTION

Mechanical ware washing machines including dishwashers have been common in the institutional and household environments for many years. Such automatic ware washing machines clean dishes using two or more cycles which can include initially a wash cycle followed by a rinse cycle. Such automatic ware washing machines can also utilize other cycles, for example, a soak cycle, a pre-wash cycle, a scrape cycle, additional wash cycles, additional rinse cycles, a sanitizing cycle, and/or a drying cycle. Any of these cycles can be repeated, if desired and additional cycles can be used. Detergents and/or sanitizers are conventionally used in these ware washing applications to provide cleaning, disinfecting and/or sanitizing. Dishmachines can remove soil by using a combination of various detergents and/or sanitizers, temperatures, and/or mechanical action from water. In some aspects where a sanitizer is not employed, water is heated to provide sanitization of the ware, placing an increase utility demand on a ware wash machine.

Alkali metal carbonate and/or hydroxide detergents are commonly employed in ware washing machines and often referred to as ash detergents and caustic detergents, respectively. Detergent formulations employing alkali metal carbonates and/or alkali metal hydroxides are known to provide effective detergency. Formulations can vary greatly in their degree of corrosiveness, acceptance as consumer-friendly and/or environmentally-friendly products, as well as other detergent characteristics. Generally, as the alkalinity of these detergent compositions increase, the difficulty in preventing hard water scale accumulation also increases. A need therefore exists for detergent compositions that minimize and/or eliminate hard water scale accumulation within systems employing these detergents. In addition, as the use of phosphorous raw materials in detergents becomes more heavily regulated, industries are seeking alternative ways to control hard water scale formation associated with highly alkaline detergents. However, many non-phosphate replacement formulations result in heavy soil accumulation on hard surfaces such as glass, plastic, rubber and/or metal surfaces. Therefore, there is a need for detergent compositions, such as ware washing compositions, to provide adequate cleaning performance while minimizing soil redeposition on a hard surfaces in contact with the detergent compositions.

In addition to detergents and sanitizers, rinse aids are also conventionally used in ware washing applications to promote drying and to prevent the formation of spots on the ware being washed. In order to reduce the formation of spotting, rinse aids have commonly been added to water to form an aqueous rinse that is sprayed on the ware after cleaning is complete. A number of rinse aids are currently known, each having certain advantages and disadvantages, such as those disclosed in U.S. Pat. Nos. 3,592,774, 3,625,901, 3,941,713, 4,005,024, 4,187,121, 4,147,559, 4,624,713. In addition, further disclosure of rinse additives including nonionic surfactants is disclosed in Schick, "Nonionic Surfactants", published by Marcel Dekker, and John L. Wilson, Soap and Chemical Specialties, February 1958, pp. 48-52 and 170-171, which is herein incorporated by reference in its entirety.

There further remains an ongoing need for improved efficacy of dishmachines, including maximizing the efficacy of the combination of detergents, sanitizers and rinse aids formulations. In addition, there is a desire among consumers, both institutional and household, to reduce the utilities required for operating such dishmachines. It is against this background that the present disclosure is made to develop a method of ware washing providing concentrated detergent compositions with a sanitizing rinse aid.

Accordingly, it is an objective of the claimed invention to develop concentrated detergent compositions suitable for combined use with a sanitizing rinse aid composition to provide methods of using the same for ware washing applications to provide desired cleaning, sanitizing and rinsing performance.

A further object of the invention is to provide a concentrated PSO adduct containing detergent composition suitable for use in ware washing applications with a non-chlorine based sanitizing system containing peroxycarboxylic acids with non-foaming rinse additives for ware washing and other applications.

Other objects, advantages and features of the present invention will become apparent from the following specification taken in conjunction with the accompanying drawings.

BRIEF SUMMARY OF THE INVENTION

The following invention is advantageous for a combined two-step method for cleaning, sanitizing and rinsing a surface in need thereof. In an embodiment, the method comprises two steps, including (1) cleaning a surface with a detergent composition comprising: an alkalinity source selected from the group consisting of an alkali metal carbonate, alkali metal hydroxide, alkali metal silicate, alkali metal metasilicate, and combinations thereof; a phosphinosuccinic acid adduct comprising a phosphinosuccinic acid and mono-, bis- and oligomeric phosphinosuccinic acid adducts; and (2) sanitizing and rinsing the surface with a sanitizing rinse composition comprising: a C1-C22 peroxycarboxylic acid; a C1-C22 carboxylic acid; hydrogen peroxide; and a nonionic defoaming and wetting surfactant(s).

In a further embodiment, a method of cleaning, sanitizing and rinsing a surface includes the steps of (1) cleaning a surface with a detergent composition comprising: an alkalinity source selected from the group consisting of an alkali metal carbonate, alkali metal hydroxide, alkali metal silicate, alkali metal metasilicate, and combinations thereof; a phosphinosuccinic acid adduct comprising a phosphinosuccinic acid and mono-, bis- and oligomeric phosphinosuccinic acid adducts having the following formulas (I)

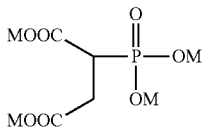

(II)

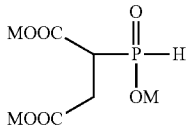

(III)

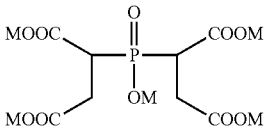

(IV)

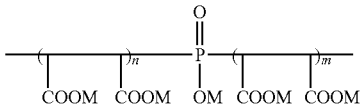

wherein M is selected from the group consisting of $H^+$, $Na^+$, $K^+$, $NH_4^+$, and mixtures thereof, wherein m and n are 0 or an integer, wherein m plus n is greater than 2, and wherein a use solution of the detergent composition has a pH between about 9 and 12.5; and (2) sanitizing and rinsing the surface with a sanitizing rinse composition comprising: a C1-C22 peroxycarboxylic acid; a C1-C22 carboxylic acid; hydrogen peroxide; and a nonionic defoaming and wetting surfactant(s), wherein the sanitizing rinse composition is a low odor concentrate having less than about 2 wt-% C1-C22 peroxycarboxylic acid, and wherein the sanitizing rinse composition when diluted from about 0.01% weight/volume to about 2% weight/volume provides at least a 5 log reduction in pathogenic organisms at a temperature of at least about 100° F.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

DETAILED DESCRIPTION OF THE PREFERRED EMBODIMENT

The present invention relates to ware washing methods that utilize a detergent composition and sanitizing rinse aid to clean, sanitize and rinse a surface. In an aspect, the detergent compositions employ alkaline compositions of phosphinosuccinic acid and mono-, bis- and oligomeric phosphinosuccinic acid adducts. The detergent compositions and methods of use thereof have many advantages over conventional alkaline detergents. For example, the detergent compositions minimize soil redeposition and hard water scale accumulation on hard surfaces under alkaline conditions from about 9 to about 12.5. In an aspect, the sanitizing rinse aid composition employ a peroxycarboxylic acid sanitizer chemistry with compatible rinse aid surfactants into a single, stable liquid concentrate. Beneficially, according to the embodiments of the invention, the liquid concentrate provides a single dual use formulation to replace conventional sanitizing and rinse aid formulations provided in separate products. As a result, the claimed methods of using the PSO-containing alkaline detergent compositions and the sanitizing rinse aid compositions in a ware wash method result in significant benefits, including: reduced soil redeposition on treated surfaces; reduced or prevented hardness accumulation on the treated surfaces; concentrated multipart compositions including the sanitizing agent, rinse additives and optional additional components in a dual use sanitizing rinse aid composition; and enables use of lower voltage and amperage dishmachine due to use of the peroxycarboxylic acid sanitizing agents.

The embodiments of this invention are not limited to particular ware wash methods which can vary and are understood by skilled artisans. It is further to be understood that all terminology used herein is for the purpose of describing particular embodiments only, and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form.

Numeric ranges recited within the specification are inclusive of the numbers defining the range and include each integer within the defined range. Throughout this disclosure, various aspects of this invention are presented in a range format. It should be understood that the description in range format is merely for convenience and brevity and should not be construed as an inflexible limitation on the scope of the invention. Accordingly, the description of a range should be considered to have specifically disclosed all the possible sub-ranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

So that the present invention may be more readily understood, certain terms are first defined. Unless defined otherwise, all technical and scientific terms used herein have the same meaning as commonly understood by one of ordinary skill in the art to which embodiments of the invention pertain. Many methods and materials similar, modified, or equivalent to those described herein can be used in the practice of the embodiments of the present invention without undue experimentation, the preferred materials and methods are described herein. In describing and claiming the embodiments of the present invention, the following terminology will be used in accordance with the definitions set out below.

The term "about," as used herein, refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities.

The term "actives" or "percent actives" or "percent by weight actives" or "actives concentration" are used interchangeably herein and refers to the concentration of those ingredients involved in cleaning expressed as a percentage minus inert ingredients such as water or salts.

As used herein, the term "alkyl" or "alkyl groups" refers to saturated hydrocarbons having one or more carbon atoms, including straight-chain alkyl groups (e.g., methyl, ethyl, propyl, butyl, pentyl, hexyl, heptyl, octyl, nonyl, decyl, etc.), cyclic alkyl groups (or "cycloalkyl" or "alicyclic" or "carbocyclic" groups) (e.g., cyclopropyl, cyclopentyl, cyclohexyl, cycloheptyl, cyclooctyl, etc.), branched-chain alkyl groups (e.g., isopropyl, tert-butyl, sec-butyl, isobutyl, etc.), and alkyl-substituted alkyl groups (e.g., alkyl-substituted cycloalkyl groups and cycloalkyl-substituted alkyl groups).

Unless otherwise specified, the term "alkyl" includes both "unsubstituted alkyls" and "substituted alkyls." As used herein, the term "substituted alkyls" refers to alkyl groups having substituents replacing one or more hydrogens on one or more carbons of the hydrocarbon backbone. Such substituents may include, for example, alkenyl, alkynyl, halogeno, hydroxyl, alkylcarbonyloxy, arylcarbonyloxy, alkoxycarbonyloxy, aryloxy, aryloxycarbonyloxy, carboxylate, alkylcarbonyl, arylcarbonyl, alkoxycarbonyl, aminocarbonyl, alkylaminocarbonyl, dialkylaminocarbonyl, alkylthiocarbonyl, alkoxyl, phosphate, phosphonato, phosphinato, cyano, amino (including alkyl amino, dialkylamino, arylamino, diarylamino, and alkylarylamino), acylamino (including alkylcarbonylamino, arylcarbonylamino, carbamoyl and ureido), imino, sulfhydryl, alkylthio, arylthio, thiocarboxylate, sulfates, alkylsulfinyl, sulfonates, sulfamoyl, sulfonamido, nitro, trifluoromethyl, cyano, azido, heterocyclic, alkylaryl, or aromatic (including heteroaromatic) groups.

In some embodiments, substituted alkyls can include a heterocyclic group. As used herein, the term "heterocyclic group" includes closed ring structures analogous to carbocyclic groups in which one or more of the carbon atoms in the ring is an element other than carbon, for example, nitrogen, sulfur or oxygen. Heterocyclic groups may be saturated or unsaturated. Exemplary heterocyclic groups include, but are not limited to, aziridine, ethylene oxide (epoxides, oxiranes), thiirane (episulfides), dioxirane, azetidine, oxetane, thietane, dioxetane, dithietane, dithiete, azolidine, pyrrolidine, pyrroline, oxolane, dihydrofuran, and furan.

An "antiredeposition agent" refers to a compound that helps keep suspended in water instead of redepositing onto the object being cleaned. Antiredeposition agents are useful in the present invention to assist in reducing redepositing of the removed soil onto the surface being cleaned.

The term "cleaning," as used herein, refers to performing or aiding in any soil removal, bleaching, microbial population reduction, or combination thereof.

The term "defoamer" or "defoaming agent," as used herein, refers to a composition capable of reducing the stability of foam. Examples of defoaming agents include, but are not limited to: ethylene oxide/propylene block copolymers such as those available under the name Pluronic N-3; silicone compounds such as silica dispersed in polydimethylsiloxane, polydimethylsiloxane, and functionalized polydimethylsiloxane such as those available under the name Abil B9952; fatty amides, hydrocarbon waxes, fatty acids, fatty esters, fatty alcohols, fatty acid soaps, ethoxylates, mineral oils, polyethylene glycol esters, and alkyl phosphate esters such as monostearyl phosphate. A discussion of defoaming agents may be found, for example, in U.S. Pat. Nos. 3,048,548, 3,334,147, and 3,442,242, the disclosures of which are incorporated herein by reference.

As used herein, the term "disinfectant" refers to an agent that kills all vegetative cells including most recognized pathogenic microorganisms, using the procedure described in *A.O.A.C. Use Dilution Methods*, Official Methods of Analysis of the Association of Official Analytical Chemists, paragraph 955.14 and applicable sections, 15th Edition, 1990 (EPA Guideline 91-2). As used herein, the term "high level disinfection" or "high level disinfectant" refers to a compound or composition that kills substantially all organisms, except high levels of bacterial spores, and is effected with a chemical germicide cleared for marketing as a sterilant by the Food and Drug Administration. As used herein, the term "intermediate-level disinfection" or "intermediate level disinfectant" refers to a compound or composition that kills mycobacteria, most viruses, and bacteria with a chemical germicide registered as a tuberculocide by the Environmental Protection Agency (EPA). As used herein, the term "low-level disinfection" or "low level disinfectant" refers to a compound or composition that kills some viruses and bacteria with a chemical germicide registered as a hospital disinfectant by the EPA.

The terms "feed water," "dilution water," and "water" as used herein, refer to any source of water that can be used with the methods and compositions of the present invention. Water sources suitable for use in the present invention include a wide variety of both quality and pH, and include but are not limited to, city water, well water, water supplied by a municipal water system, water supplied by a private water system, and/or water directly from the system or well. Water can also include water from a used water reservoir, such as a recycle reservoir used for storage of recycled water, a storage tank, or any combination thereof. Water also includes food process or transport waters. It is to be understood that regardless of the source of incoming water for systems and methods of the invention, the water sources may be further treated within a manufacturing plant. For example, lime may be added for mineral precipitation, carbon filtration may remove odoriferous contaminants, additional chlorine or chlorine dioxide may be used for disinfection or water may be purified through reverse osmosis taking on properties similar to distilled water.

As used herein, the term "microorganism" refers to any noncellular or unicellular (including colonial) organism. Microorganisms include all prokaryotes. Microorganisms include bacteria (including cyanobacteria), spores, lichens, fungi, protozoa, virinos, viroids, viruses, phages, and some algae. As used herein, the term "microbe" is synonymous with microorganism.

For the purpose of this patent application, successful microbial reduction is achieved when the microbial populations are reduced by at least about 50%, or by significantly more than is achieved by a wash with water. Larger reductions in microbial population provide greater levels of protection.

As used herein, the term "phosphorus-free" or "substantially phosphorus-free" refers to a composition, mixture, or ingredient that does not contain phosphorus or a phosphorus-containing compound or to which phosphorus or a phosphorus-containing compound has not been added. Should phosphorus or a phosphorus-containing compound be present through contamination of a phosphorus-free composition, mixture, or ingredients, the amount of phosphorus shall be less than 0.5 wt %. More preferably, the amount of phosphorus is less than 0.1 wt-%, and most preferably the amount of phosphorus is less than 0.01 wt % in phosphorus-free compositions. In an aspect of the invention, the detergent warewashing compositions may be phosphorus-free. As used herein, the term "sanitizer" refers to an agent that reduces the number of bacterial contaminants to safe levels as judged by public health requirements. In an embodiment, sanitizers for use in this invention will provide at least a 99.999% reduction (5-log order reduction). These reductions can be evaluated using a procedure set out in *Germicidal and Detergent Sanitizing Action of Disinfectants*, Official Methods of Analysis of the Association of Official Analytical Chemists, paragraph 960.09 and applicable sections, 15th Edition, 1990 (EPA Guideline 91-2). According to this reference a sanitizer should provide a 99.999% reduction (5-log order reduction) within 30 seconds at room temperature, 25±2° C., against several test organisms. According to other aspects of the invention, a sanitizer provides a 99.999% reduction (5-log order reduction) at a temperature of at least about 100° F. against several test organisms, including gram negative organisms.

As used herein, the term "soil" or "stain" refers to a non-polar oily substance which may or may not contain particulate matter such as mineral clays, sand, natural mineral matter, carbon black, graphite, kaolin, environmental dust, etc.

As used herein, the term "substantially free" refers to compositions completely lacking the component or having such a small amount of the component that the component does not affect the performance of the composition. The component may be present as an impurity or as a contaminant and shall be less than 0.5 wt-%. In another embodiment, the amount of the component is less than 0.1 wt-% and in yet another embodiment, the amount of component is less than 0.01 wt-%.

The term "substantially similar cleaning performance" refers generally to achievement by a substitute cleaning product or substitute cleaning system of generally the same degree (or at least not a significantly lesser degree) of cleanliness or with generally the same expenditure (or at least not a significantly lesser expenditure) of effort, or both.

As used herein, the term "sulfoperoxycarboxylic acid," "sulfonated peracid," or "sulfonated peroxycarboxylic acid" refers to the peroxycarboxylic acid form of a sulfonated carboxylic acid. In some embodiments, the sulfonated peracids of the present invention are mid-chain sulfonated peracids. As used herein, the term "mid-chain sulfonated peracid" refers to a peracid compound that includes a sulfonate group attached to a carbon that is at least one carbon (e.g., the three position or further) from the carbon of the percarboxylic acid group in the carbon backbone of the percarboxylic acid chain, wherein the at least one carbon is not in the terminal position. As used herein, the term "terminal position," refers to the carbon on the carbon backbone chain of a percarboxylic acid that is furthest from the percarboxyl group.

As used herein, the term "ware" refers to items such as eating and cooking utensils, dishes, and other hard surfaces such as showers, sinks, toilets, bathtubs, countertops, windows, mirrors, transportation vehicles, and floors. As used herein, the term "ware washing" refers to washing, cleaning, or rinsing ware. Ware also refers to items made of plastic. Types of plastics that can be cleaned with the compositions according to the invention include but are not limited to, those that include polycarbonate polymers (PC), acrilonitrile-butadiene-styrene polymers (ABS), and polysulfone polymers (PS). Another exemplary plastic that can be cleaned using the compounds and compositions of the invention include polyethylene terephthalate (PET).

The term "weight percent," "wt-%," "percent by weight," "% by weight," and variations thereof, as used herein, refer to the concentration of a substance as the weight of that substance divided by the total weight of the composition and multiplied by 100. It is understood that, as used here, "percent," "%," and the like are intended to be synonymous with "weight percent," "wt-%," etc.

The methods and compositions of the present invention may comprise, consist essentially of, or consist of the components and ingredients of the present invention as well as other ingredients described herein. As used herein, "consisting essentially of" means that the methods and compositions may include additional steps, components or ingredients, but only if the additional steps, components or ingredients do not materially alter the basic and novel characteristics of the claimed methods and compositions.

Alkaline Detergent Compositions Comprising PSO Adducts

According to an embodiment of the invention, alkaline detergents incorporate phosphinosuccinic acid (PSO) adducts. In an aspect, the alkaline detergents comprise, consist of and/or consist essentially of phosphinosuccinic acid (PSO) adducts and a source of alkalinity. In a further aspect, the alkaline detergents comprise, consist of and/or consist essentially of phosphinosuccinic acid (PSO) adducts, a source of alkalinity, water and/or surfactants and/or polymers and/or any combination of the same. Additional detergent compositions may incorporate the PSO adducts according to the invention, including for example, those disclosed in U.S. Publication No. 2014/0073550, having beneficial solid, dimensional stability, which is herein incorporated by reference.

An example of a suitable detergent composition for use according to the invention may comprise, consist and/or consist essentially of about 1-90 wt-% alkalinity source(s), from about 1-50 wt-% of the alkalinity source(s) from about 1-40 wt-% of the alkalinity source(s), and preferably about 1-40 wt-% alkalinity source(s); about 0.01-40 wt-% PSO adducts, preferably about 0.1-20 wt-% PSO adducts; and optionally about 0-45 wt-% polymers, preferably from about 0-25 wt-% polymers; and optionally other chelating agents, polymers and/or surfactants, oxidizers, and other functional ingredients, including for example preferably about 0-40 wt-% surfactant, and more preferably from about 0-25 wt-% surfactant.

An example of a suitable detergent use solution composition for use according to the invention may comprise, consist and/or consist essentially of about from about 100-20,000 ppm of an alkalinity source, from about 1-2,000 ppm phosphinosuccinic acid adducts, and from about 1-1,000 ppm of a polymer having a use pH of between about 9 and about 12.5.

Further description of suitable formulations is shown below in Table 1:

TABLE 1

| Formulations | | | |
|---|---|---|---|
| Water | 0-90 wt-% | 20-90 wt-% | 40-80 wt-% |
| Alkalinity source | 1-90 wt-% | 1-50 wt-% | 1-40 wt-% |
| PSO adducts | 0.01-40 wt-% | 0.1-20 wt-% | 0.1-10 wt-% |
| Optional Polymers | 0-45 wt-% | 0-25 wt-% | 0-10 wt-% |
| Optional Surfactant(s) | 0-40 wt-% | 0-25 wt-% | 0-10 wt-% |
| Optional Additional Agents | 0-40 wt-% | 0-25 wt-% | 0-20 wt-% |

Use solutions of the detergent compositions have a pH greater than about 9, or great than about 10. In further aspects, the pH of the detergent composition use solution is between about 9 and 12.5. Beneficially, the detergent compositions of the invention provide effective prevention of hardness scale accumulation on treated surfaces at such alkaline pH conditions as well as provide beneficially reduction and/or prevention of soil redeposition on treated surfaces. Without being limited to a particular theory of the invention, it is unexpected to have effective cleaning without the accumulation of hardness scaling at alkaline conditions above pH about 9 wherein alkalinity sources are employed.

Beneficially, alkaline compositions according to the invention may be provided in various forms, including liquids, solids, powders, pastes and/or gels. Moreover, the alkaline compositions can be provided in use concentration and/or concentrates, such that use solutions may be obtained at a point of use or may be used without further dilution in the case of concentrate compositions. The alkaline compositions are suitable for dilution with a water source.

Phosphinosuccinic Acid (PSO) Adducts

The detergent compositions employ phosphinosuccinic acid (PSO) adducts providing water conditioning benefits including the reduction of hardness scale buildup. PSO adducts may also be described as phosphonic acid-based compositions. In an aspect of the invention, the PSO adducts are a combination of mono-, bis- and oligomeric phosphinosuccinic acid adducts and a phosphinosuccinic acid (PSA) adduct.

The phosphinosuccinic acid (PSA) adducts have the formula (I) below:

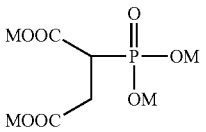

The mono-phosphinosuccinic acid adducts have the formula (II) below:

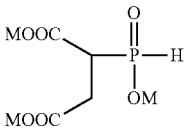

The bis-phosphinosuccinic acid adducts have the formula (III) below:

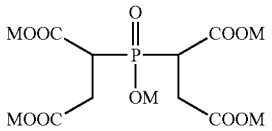

An exemplary structure for the oligomeric phosphinosuccinic acid adducts is shown in formula (IV) below:

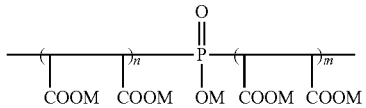

where M is $H^+$, $Na^+$, $K^+$, $NH_4^+$, or mixtures thereof; and the sum of m plus n is greater than 2.

In an aspect, the phosphinosuccinic acid adducts are a combination of various phosphinosuccinic acid adducts as shown in Formulas I-IV. In a preferred aspect, the phosphinosuccinic acid adduct of formula I constitutes between about 1-40 wt-% of the phosphinosuccinic acid adducts, the phosphinosuccinic acid adduct of formula II constitutes between about 1-25 wt-% of the phosphinosuccinic acid adducts, the phosphinosuccinic acid adduct of formula III constitutes between about 10-60 wt-% of the phosphinosuccinic acid adducts, the phosphinosuccinic acid adduct of formula IV constitutes between about 20-70 wt-% of the phosphinosuccinic acid adduct. Without being limited according to embodiments of the invention, all recited ranges for the phosphinosuccinic acid adducts are inclusive of the numbers defining the range and include each integer within the defined range.

Additional oligomeric phosphinosuccinic acid adduct structures are set forth for example in U.S. Pat. Nos. 5,085,794, 5,023,000 and 5,018,577, each of which are incorporated herein by reference in their entirety. The oligomeric species may also contain esters of phosphinosuccinic acid, where the phosphonate group is esterified with a succinate-derived alkyl group. Furthermore, the oligomeric phosphinosuccinic acid adduct may comprise 1-20 wt % of additional monomers selected, including, but not limited to acrylic acid, methacrylic acid, itaconic acid, 2-acylamido-2-methylpropane sulfonic acid (AMPS), and acrylamide.

The adducts of formula I, II, III and IV may be used in the acid or salt form. Further, in addition to the phosphinosuccinic acids and oligomeric species, the mixture may also contain some phosphinosuccinic acid adduct (I) from the oxidation of adduct II, as well as impurities such as various inorganic phosphorous byproducts of formula $H_2PO_2$—, $HPO_3^{2-}$ and $PO_4^{3-}$.

In an aspect, the mono-, bis- and oligomeric phosphinosuccinic acid adducts and the phosphinosuccinic acid (PSA) may be provided in the following mole and weight ratios as shown in Table 2.

TABLE 2

| Species: | Mono | PSA | Bis | Oligomer |
|---|---|---|---|---|
| Formula | $C_4H_7PO_6$ | $C_4H_7PO_7$ | $C_8H_{11}PO_{10}$ | $C_{14.1}H_{17.1}PO_{16.1}$ |
| MW | 182 | 198 | 298 | 475.5 (avg) |
| Mole fraction (by NMR) | 0.238 | 0.027 | 0.422 | 0.309 |
| Wt. fraction (as acid) | 0.135 | 0.017 | 0.391 | 0.457 |

Detergent compositions and methods of use may employ the phosphinosuccinic acid adducts and may include one or more of PSO adducts selected from mono-, bis- and oligomeric phosphinosuccinic acid and a phosphinosuccinic acid, wherein at least about 10 mol % of the adduct comprises a succinic acid:phosphorus ratio of about 1:1 to about 20:1. More preferably, the phosphinosuccinic acid adduct may include one or more of the PSO adducts selected from mono-, bis- and oligomeric phosphinosuccinic acid and optionally a phosphinosuccinic acid wherein at least about 10 mol % of the adduct comprises a succinic acid:phosphorus ratio of about 1:1 to about 15:1. Most preferably, the phosphinosuccinic acid adduct may include one or more adducts selected from mono-, bis- and oligomeric phosphinosuccinic acid and optionally a phosphinosuccinic acid wherein at least about 10 mol % of the adduct comprises a succinic acid:phosphorus ratio of about 1:1 to about 10:1.

Additional description of suitable mono-, bis- and oligomeric phosphinosuccinic acid adducts for use as the PSO adducts of the present invention is provided in U.S. Pat. No. 6,572,789 which is incorporated herein by reference in its entirety.

In aspects of the invention the detergent composition is nitrilotriacetic acid (NTA)-free to meet certain regulations. In additional aspects of the invention the detergent composition may be substantially phosphorous (and phosphate) free to meet certain regulations. The PSO adducts of the claimed invention may provide substantially phosphorous (and phosphate) free detergent compositions having less than about 0.5 wt-% of phosphorus (and phosphate). More preferably, the amount of phosphorus is a detergent composition may be less than about 0.1 wt-%. Accordingly, it is a benefit of the detergent compositions of the present invention to provide detergent compositions capable of controlling (i.e. preventing) hardness scale accumulation and soil redeposition on a substrate surface without the use of phosphates, such as tripolyphosphates including sodium tripolyphosphate, commonly used in detergents to prevent hardness scale and/or accumulation.

Alkalinity Source

According to an embodiment of the invention, the detergent compositions include an alkalinity source. Exemplary alkalinity sources include alkali metal hydroxides, alkali metal carbonates and/or alkali metal silicates. In various aspects, a combination of alkalinity sources is employed, such as both alkali metal hydroxides and alkali metal silicates and/or alkali metal metasilicates, or both alkali metal hydroxides and alkali metal carbonates, are employed as the alkalinity source.

Alkali metal carbonates used in the formulation of detergents are often referred to as ash-based detergents and most often employ sodium carbonate. Additional alkali metal carbonates include, for example, sodium or potassium carbonate. In aspects of the invention, the alkali metal carbonates are further understood to include metasilicates, silicates, bicarbonates and sesquicarbonates. According to the invention, any "ash-based" or "alkali metal carbonate" shall also be understood to include all alkali metal carbonates, metasilicates, silicates, bicarbonates and/or sesquicarbonates.

Alkali metal hydroxides used in the formulation of detergents are often referred to as caustic detergents. Examples of suitable alkali metal hydroxides include sodium hydroxide, potassium hydroxide, and lithium hydroxide. The alkali metal hydroxides may be added to the composition in any form known in the art, including as solid beads, dissolved in an aqueous solution, or a combination thereof. Alkali metal hydroxides are commercially available as a solid in the form of prilled solids or beads having a mix of particle sizes ranging from about 12-100 U.S. mesh, or as an aqueous solution, as for example, as a 45% and a 50% by weight solution.

In addition to the first alkalinity source, i.e. the alkali metal hydroxide, the detergent composition may comprise a secondary alkalinity source. Examples of useful secondary alkaline sources include, but are not limited to: alkali metal silicates or metasilicates, such as sodium or potassium silicate or metasilicate; and ethanolamines and amines. Such alkalinity agents are commonly available in either aqueous or powdered form, either of which is useful in formulating the present detergent compositions.

An effective amount of one or more alkalinity sources is provided in the detergent composition. An effective amount is referred to herein as an amount that provides a use composition having a pH of at least about 9 or at least about 10, preferably at least about 10.5. When the use composition has a pH of about 10, it can be considered mildly alkaline, and when the pH is greater than about 12, the use composition can be considered caustic. In some circumstances, the detergent composition may provide a use composition that has a pH between about 9 and about 12.5.

Additional Functional Ingredients

The components of the detergent composition can be combined with various additional functional ingredients. In some embodiments, the detergent composition including the PSO adducts and alkalinity source(s) make up a large amount, or even substantially all of the total weight of the detergent composition, for example, in embodiments having few or no additional functional ingredients disposed therein. In these embodiments, the component concentrations ranges provided above for the detergent composition are representative of the ranges of those same components in the detergent composition. In other aspects, the detergent compositions include PSO adducts, alkalinity source(s), threshold active polymer(s)/surfactant(s), and water, having few or no additional functional ingredients disposed therein. In still other aspects, the detergent compositions include PSO adducts, alkalinity source(s), and a polymer, having few or no additional functional ingredients disposed therein.

The functional ingredients provide desired properties and functionalities to the detergent composition. For the purpose of this application, the term "functional ingredients" includes an ingredient that when dispersed or dissolved in a use and/or concentrate, such as an aqueous solution, provides a beneficial property in a particular use. Some particular examples of functional ingredients are discussed in more detail below, although the particular materials discussed are given by way of example only, and that a broad variety of other functional ingredients may be used. For example, many of the functional ingredients discussed below relate to materials used in cleaning applications. However, other embodiments may include functional ingredients for use in other applications.

Exemplary additional functional ingredients include for example: builders or water conditioners, including detergent builders; hardening agents; bleaching agents; fillers; defoaming agents; anti-redeposition agents; stabilizing agents; dispersants; enzymes; glass and metal corrosion inhibitors; oxidizers; chelants; fragrances and dyes; thickeners; etc. Further description of suitable additional functional ingredients is set forth in U.S. Patent Publication No. 2012/0165237, which is incorporated herein by reference in its entirety.

Polymers

In some embodiments, the compositions of the present invention include a water conditioning polymer. Water conditioning polymers suitable for use with the compositions of the present invention include, but are not limited to polycarboxylates or polycarboxylic acids. Exemplary polycarboxylates that can be used as builders and/or water conditioning polymers include, but are not limited to: those having pendant carboxylate ($—CO_2^-$) groups such as acrylic homopolymers, polyacrylic acid, maleic acid, maleic/olefin copolymer, sulfonated copolymer or terpolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, and hydrolyzed acrylonitrile-methacrylonitrile copolymers.

In another aspect, the polycarboxylic acid polymer may be a non-phosphorus polymer. In a still further aspect, the polycarboxylic acid polymer may be hydrophobically modified. In a still further aspect, the polycarboxylic acid polymer may be a neutralized polycarboxylic acid polymer. An example of a suitable commercially-available polymer includes Acumer® 1000 (available from Dow Chemical). For a further discussion of water conditioning polymers, see Kirk-Othmer, Encyclopedia of Chemical Technology, Third Edition, volume 5, pages 339-366 and volume 23, pages 319-320, the disclosure of which is incorporated by reference herein.

In an aspect where a water conditioning polymer is employed, it is preferred that between about 0-45 wt-% polymer are included in the composition, preferably from about 0-25 wt-% polymer, and more preferably from about 0-10 wt-% polymer.

Surfactants

In some embodiments, the compositions of the present invention include at least one surfactant. Surfactants suitable for use with the compositions of the present invention include, but are not limited to, anionic surfactants, nonionic surfactants, cationic surfactants, amphoteric surfactants and/or zwitterionic surfactants. In a preferred aspect, anionic surfactants are employed. In some embodiments, the compositions of the present invention include about 0-40 wt-% of a surfactant. In other embodiments the compositions of the present invention include about 0-25 wt-% of a surfactant.

In certain embodiments of the invention the detergent composition does not require a surfactant and/or other polymer in addition to the PSO adducts. In an embodiment, the detergent compositions employ at least one nonionic surfactant to provide defoaming properties to the composition. In an embodiment, the detergent composition employs an alkoxylated surfactant (e.g. EO/PO copolymers). In alternative embodiments, the detergent compositions employ at least one anionic surfactant to provide improved detergency to the composition. In an embodiment, the detergent composition employs a sulfonate, sulphate or carboxylate anionic surfactant. In a further embodiment, the detergent compositions employ at least one nonionic surfactant and an anionic surfactant.

Nonionic Surfactants

Suitable nonionic surfactants suitable for use with the compositions of the present invention include alkoxylated surfactants. Suitable alkoxylated surfactants include EO/PO copolymers, capped EO/PO copolymers, alcohol alkoxylates, capped alcohol alkoxylates, mixtures thereof, or the like. Suitable alkoxylated surfactants for use as solvents include EO/PO block copolymers, such as the Pluronic® and reverse Pluronic® surfactants; alcohol alkoxylates; capped alcohol alkoxylates; mixtures thereof, or the like.

Useful nonionic surfactants are generally characterized by the presence of an organic hydrophobic group and an organic hydrophilic group and are typically produced by the condensation of an organic aliphatic, alkyl aromatic or polyoxyalkylene hydrophobic compound with a hydrophilic alkaline oxide moiety which in common practice is ethylene oxide or a polyhydration product thereof, polyethylene glycol. Practically any hydrophobic compound having a hydroxyl, carboxyl, amino, or amido group with a reactive hydrogen atom can be condensed with ethylene oxide, or its polyhydration adducts, or its mixtures with alkoxylenes such as propylene oxide to form a nonionic surface-active agent. The length of the hydrophilic polyoxyalkylene moiety which is condensed with any particular hydrophobic compound can be readily adjusted to yield a water dispersible or water soluble compound having the desired degree of balance between hydrophilic and hydrophobic properties.

Block polyoxypropylene-polyoxyethylene polymeric compounds based upon propylene glycol, ethylene glycol, glycerol, trimethylolpropane, and ethylenediamine as the initiator reactive hydrogen compound are suitable nonionic surfactants. Examples of polymeric compounds made from a sequential propoxylation and ethoxylation of initiator are commercially available under the trade names Pluronic® and Tetronic® manufactured by BASF Corp.

Pluronic® compounds are difunctional (two reactive hydrogens) compounds formed by condensing ethylene oxide with a hydrophobic base formed by the addition of propylene oxide to the two hydroxyl groups of propylene glycol. This hydrophobic portion of the molecule weighs from about 1,000 to about 4,000. Ethylene oxide is then added to sandwich this hydrophobe between hydrophilic groups, controlled by length to constitute from about 10% by weight to about 80% by weight of the final molecule.

Tetronic® compounds are tetra-functional block copolymers derived from the sequential addition of propylene oxide and ethylene oxide to ethylenediamine. The molecular weight of the propylene oxide hydrotype ranges from about 500 to about 7,000; and, the hydrophile, ethylene oxide, is added to constitute from about 10% by weight to about 80% by weight of the molecule.

Semi-Polar Nonionic Surfactants

The semi-polar type of nonionic surface active agents are another class of nonionic surfactant useful in compositions of the present invention. Semi-polar nonionic surfactants include the amine oxides, phosphine oxides, sulfoxides and their alkoxylated derivatives.

Amine oxides are tertiary amine oxides corresponding to the general formula:

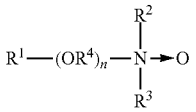

wherein the arrow is a conventional representation of a semi-polar bond; and, $R^1$, $R^2$, and $R^3$ may be aliphatic, aromatic, heterocyclic, alicyclic, or combinations thereof. Generally, for amine oxides of detergent interest, $R^1$ is an alkyl radical of from about 8 to about 24 carbon atoms; $R^2$ and $R^3$ are alkyl or hydroxyalkyl of 1-3 carbon atoms or a mixture thereof; $R^2$ and $R^3$ can be attached to each other, e.g.

through an oxygen or nitrogen atom, to form a ring structure; $R^4$ is an alkylene or a hydroxyalkylene group containing 2 to 3 carbon atoms; and n ranges from 0 to about 20. An amine oxide can be generated from the corresponding amine and an oxidizing agent, such as hydrogen peroxide.

Useful semi-polar nonionic surfactants also include the water soluble phosphine oxides having the following structure:

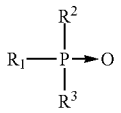

wherein the arrow is a conventional representation of a semi-polar bond; and, $R^1$ is an alkyl, alkenyl or hydroxyalkyl moiety ranging from 10 to about 24 carbon atoms in chain length; and, $R^2$ and $R^3$ are each alkyl moieties separately selected from alkyl or hydroxyalkyl groups containing 1 to 3 carbon atoms.

Examples of useful phosphine oxides include dimethyldecylphosphine oxide, dimethyltetradecylphosphine oxide, methylethyltetradecylphosphone oxide, dimethylhexadecylphosphine oxide, diethyl-2-hydroxyoctyldecylphosphine oxide, bis(2-hydroxyethyl)dodecylphosphine oxide, and bis(hydroxymethyl)tetradecylphosphine oxide. Useful water soluble amine oxide surfactants are selected from the octyl, decyl, dodecyl, isododecyl, coconut, or tallow alkyl di-(lower alkyl) amine oxides, specific examples of which are octyldimethylamine oxide, nonyldimethylamine oxide, decyldimethylamine oxide, undecyldimethylamine oxide, dodecyldimethylamine oxide, iso-dodecyldimethyl amine oxide, tridecyldimethylamine oxide, tetradecyldimethylamine oxide, pentadecyldimethylamine oxide, hexadecyldimethylamine oxide, heptadecyldimethylamine oxide, octadecyldimethylaine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl)amine oxide, 3,6,9-trioctadecyldimethylamine oxide and 3-dodecoxy-2-hydroxypropyldi-(2-hydroxyethyl)amine oxide.

Semi-polar nonionic surfactants useful herein also include the water soluble sulfoxide compounds which have the structure:

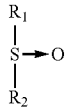

wherein the arrow is a conventional representation of a semi-polar bond; and, $R^1$ is an alkyl or hydroxyalkyl moiety of about 8 to about 28 carbon atoms, from 0 to about 5 ether linkages and from 0 to about 2 hydroxyl substituents; and $R^2$ is an alkyl moiety consisting of alkyl and hydroxyalkyl groups having 1 to 3 carbon atoms. Useful examples of these sulfoxides include dodecyl methyl sulfoxide; 3-hydroxy tridecyl methyl sulfoxide; 3-methoxy tridecyl methyl sulfoxide; and 3-hydroxy-4-dodecoxybutyl methyl sulfoxide.

Preferred semi-polar nonionic surfactants for the compositions of the invention include dimethyl amine oxides, such as lauryl dimethyl amine oxide, myristyl dimethyl amine oxide, cetyl dimethyl amine oxide, combinations thereof, and the like. Alkoxylated amines or, most particularly, alcohol alkoxylated/aminated/alkoxylated surfactants are also suitable for use according to the invention. These non-ionic surfactants may be at least in part represented by the general formulae: $R^{20}$—$(PO)_sN$-$(EO)_tH$, $R^{20}$—$(PO)_sN$-$(EO)_tH(EO)_uH$, and $R^{20}$—$N(EO)_tH$; in which $R^{20}$ is an alkyl, alkenyl or other aliphatic group, or an alkyl-aryl group of from 8 to 20, preferably 12 to 14 carbon atoms, EO is oxyethylene, PO is oxypropylene, s is 1 to 20, preferably 2-5, t is 1-10, preferably 2-5, and u is 1-10, preferably 2-5. Other variations on the scope of these compounds may be represented by the alternative formula: $R^{20}$—$(PO)_v$—N $[(EO)_wH][(EO)_zH]$ in which $R^{20}$ is as defined above, v is 1 to 20 (e.g., 1, 2, 3, or 4 (preferably 2)), and w and z are independently 1-10, preferably 2-5. These compounds are represented commercially by a line of products sold by Huntsman Chemicals as nonionic surfactants.

Anionic Surfactants

Also useful in the present invention are surface active substances which are categorized as anionics because the charge on the hydrophobe is negative; or surfactants in which the hydrophobic section of the molecule carries no charge unless the pH is elevated to neutrality or above (e.g. carboxylic acids). Carboxylate, sulfonate, sulfate and phosphate are the polar (hydrophilic) solubilizing groups found in anionic surfactants. Of the cations (counter ions) associated with these polar groups, sodium, lithium and potassium impart water solubility; ammonium and substituted ammonium ions provide both water and oil solubility; and, calcium, barium, and magnesium promote oil solubility.

Generally, anionics have high foam profiles which may limit applications of use for cleaning systems such as CIP circuits that require strict foam control. However, other applications of use, including high foaming applications are suitable for using anionic surface active compounds to impart special chemical or physical properties. The majority of large volume commercial anionic surfactants can be subdivided into five major chemical classes and additional sub-groups known to those of skill in the art and described in "Surfactant Encyclopedia," Cosmetics & Toiletries, Vol. 104 (2) 71-86 (1989). The first class includes acylamino acids (and salts), such as acylgluamates, acyl peptides, sarcosinates (e.g. N-acyl sarcosinates), taurates (e.g. N-acyl taurates and fatty acid amides of methyl tauride), and the like. The second class includes carboxylic acids (and salts), such as alkanoic acids (and alkanoates), ester carboxylic acids (e.g. alkyl succinates), ether carboxylic acids, and the like. The third class includes sulfonic acids (and salts), such as isethionates (e.g. acyl isethionates), alkylaryl sulfonates, alkyl sulfonates, sulfosuccinates (e.g. monoesters and diesters of sulfosuccinate), and the like. The fifth class includes sulfuric acid esters (and salts), such as alkyl ether sulfates, alkyl sulfates, and the like.

Anionic sulfonate surfactants suitable for use in the present compositions include alkyl sulfonates, the linear and branched primary and secondary alkyl sulfonates, and the aromatic sulfonates with or without substituents. Anionic sulfate surfactants suitable for use in the present compositions include alkyl ether sulfates, alkyl sulfates, the linear and branched primary and secondary alkyl sulfates, alkyl ethoxysulfates, fatty oleyl glycerol sulfates, alkyl phenol ethylene oxide ether sulfates, the $C_5$-$C_{17}$ acyl-N—($C_1$-$C_4$ alkyl) and —N—($C_1$-$C_2$ hydroxyalkyl) glucamine sulfates, and sulfates of alkylpolysaccharides such as the sulfates of alkylpolyglucoside, and the like. Also included are the alkyl sulfates, alkyl poly(ethyleneoxy) ether sulfates and aromatic poly(ethyleneoxy) sulfates such as the sulfates or condensation products of ethylene oxide and nonyl phenol (usually having 1 to 6 oxyethylene groups per molecule). Particularly suitable anionic sulfonates include alkyldiphenyloxide disulfonates, including for example C6 alkylated diphenyl oxide disulfonic acid, commercially-available under the tradename Dowfax.

Anionic carboxylate surfactants suitable for use in the present compositions include carboxylic acids (and salts), such as alkanoic acids (and alkanoates), ester carboxylic acids (e.g. alkyl succinates), ether carboxylic acids, and the like. Such carboxylates include alkyl ethoxy carboxylates, alkyl aryl ethoxy carboxylates, alkyl polyethoxy polycarboxylate surfactants and soaps (e.g. alkyl carboxyls). Secondary carboxylates useful in the present compositions include those which contain a carboxyl unit connected to a secondary carbon. The secondary carbon can be in a ring structure, e.g. as in p-octyl benzoic acid, or as in alkyl-substituted cyclohexyl carboxylates. The secondary carboxylate surfactants typically contain no ether linkages, no ester linkages and no hydroxyl groups. Further, they typically lack nitrogen atoms in the head-group (amphiphilic portion). Suitable secondary soap surfactants typically contain 11-13 total carbon atoms, although more carbons atoms (e.g., up to 16) can be present. Suitable carboxylates also include acylamino acids (and salts), such as acylgluamates, acyl peptides, sarcosinates (e.g. N-acyl sarcosinates), taurates (e.g. N-acyl taurates and fatty acid amides of methyl tauride), and the like.

Suitable anionic carboxylate surfactants may further include polycarboxylates or related copolymers. A variety of such polycarboxylate polymers and copolymers are known and described in patent and other literature, and are available commercially. Exemplary polycarboxylates that may be utilized according to the invention include for example: homopolymers and copolymers of polyacrylates; polymethacrylates; polymalates; materials such as acrylic, olefinic and/or maleic polymers and/or copolymers. Various examples of commercially-available agents, namely acrylic-maleic acid copolymers include, for example: Acusol 445N and Acusol 448 (available from Dow Chemical. Examples of suitable acrylic-maleic acid copolymers include, but are not limited to, acrylic-maleic acid copolymers having a molecular weight of between about 1,000 to about 100,000 g/mol, particularly between about 1,000 and about 75,000 g/mol and more particularly between about 1,000 and about 50,000 g/mol.

Suitable anionic surfactants include alkyl or alkylaryl ethoxy carboxylates of the following formula:

$$R—O—(CH_2CH_2O)_n(CH_2)_m—CO_2X \quad (3)$$

in which R is a $C_8$ to $C_{22}$ alkyl group or

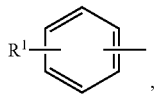

in which $R^1$ is a $C_4$-$C_{16}$ alkyl group; n is an integer of 1-20; m is an integer of 1-3; and X is a counter ion, such as hydrogen, sodium, potassium, lithium, ammonium, or an amine salt such as monoethanolamine, diethanolamine or triethanolamine. In some embodiments, n is an integer of 4 to 10 and m is 1. In some embodiments, R is a $C_8$-$C_{16}$ alkyl group. In some embodiments, R is a $C_{12}$-$C_{14}$ alkyl run is 4, and m is 1.

In other embodiments, R is

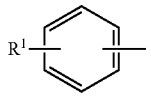

and $R^1$ is a $C_6$-$C_{12}$ alkyl group. In still yet other embodiments, $R^1$ is a $C_9$ alkyl group, n is 10 and m is 1.

Such alkyl and alkylaryl ethoxy carboxylates are commercially available. These ethoxy carboxylates are typically available as the acid forms, which can be readily converted to the anionic or salt form. Commercially available carboxylates include, Neodox 23-4, a $C_{12-13}$ alkyl polyethoxy (4) carboxylic acid (Shell Chemical), and Emcol CNP-110, a $C_9$ alkylaryl polyethoxy (10) carboxylic acid (Witco Chemical). Carboxylates are also available from Clariant, e.g. the product Sandopan® DTC, a $C_{13}$ alkyl polyethoxy (7) carboxylic acid.

Amphoteric Surfactants

Amphoteric, or ampholytic, surfactants contain both a basic and an acidic hydrophilic group and an organic hydrophobic group. These ionic entities may be any of anionic or cationic groups described herein for other types of surfactants. A basic nitrogen and an acidic carboxylate group are the typical functional groups employed as the basic and acidic hydrophilic groups. In a few surfactants, sulfonate, sulfate, phosphonate or phosphate provide the negative charge.

Amphoteric surfactants can be broadly described as derivatives of aliphatic secondary and tertiary amines, in which the aliphatic radical may be straight chain or branched and wherein one of the aliphatic substituents contains from about 8 to 18 carbon atoms and one contains an anionic water solubilizing group, e.g., carboxy, sulfo, sulfato, phosphato, or phosphino. Amphoteric surfactants are subdivided into two major classes known to those of skill in the art and described in "Surfactant Encyclopedia" Cosmetics & Toiletries, Vol. 104 (2) 69-71 (1989), which is herein incorporated by reference in its entirety. The first class includes acyl/dialkyl ethylenediamine derivatives (e.g. 2-alkyl hydroxyethyl imidazoline derivatives) and their salts. The second class includes N-alkylamino acids and their salts. Some amphoteric surfactants can be envisioned as fitting into both classes.

Amphoteric surfactants can be synthesized by methods known to those of skill in the art. For example, 2-alkyl hydroxyethyl imidazoline is synthesized by condensation and ring closure of a long chain carboxylic acid (or a derivative) with dialkyl ethylenediamine. Commercial amphoteric surfactants are derivatized by subsequent hydrolysis and ring-opening of the imidazoline ring by alkylation—for example with chloroacetic acid or ethyl acetate. During alkylation, one or two carboxy-alkyl groups react to form a tertiary amine and an ether linkage with differing alkylating agents yielding different tertiary amines.

Long chain imidazole derivatives having application in the present invention generally have the general formula:

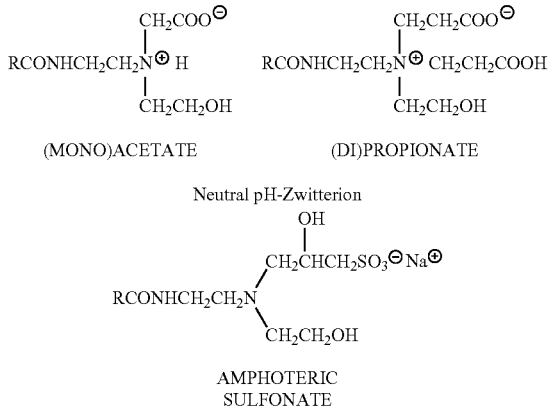

wherein R is an acyclic hydrophobic group containing from about 8 to 18 carbon atoms and M is a cation to neutralize the charge of the anion, generally sodium. Commercially prominent imidazoline-derived amphoterics that can be employed in the present compositions include for example: Cocoamphopropionate, Cocoamphocarboxy-propionate, Cocoamphoglycinate, Cocoamphocarboxy-glycinate, Cocoamphopropyl-sulfonate, and Cocoamphocarboxy-propionic acid. Amphocarboxylic acids can be produced from fatty imidazolines in which the dicarboxylic acid functionality of the amphodicarboxylic acid is diacetic acid and/or dipropionic acid.

The carboxymethylated compounds (glycinates) described herein above frequently are called betaines. Betaines are a special class of amphoteric discussed herein below in the section entitled, Zwitterion Surfactants.

Long chain N-alkylamino acids are readily prepared by reaction $RNH_2$, in which R═$C_8$-$C_{18}$ straight or branched chain alkyl, fatty amines with halogenated carboxylic acids. Alkylation of the primary amino groups of an amino acid leads to secondary and tertiary amines. Alkyl substituents may have additional amino groups that provide more than one reactive nitrogen center. Most commercial N-alkylamine acids are alkyl derivatives of beta-alanine or beta-N(2-carboxyethyl) alanine. Examples of commercial N-alkylamino acid ampholytes having application in this invention include alkyl beta-amino dipropionates, $RN(C_2H_4COOM)_2$ and $RNHC_2H_4COOM$. In an embodiment, R can be an acyclic hydrophobic group containing from about 8 to about 18 carbon atoms, and M is a cation to neutralize the charge of the anion.

Suitable amphoteric surfactants include those derived from coconut products such as coconut oil or coconut fatty acid. Additional suitable coconut derived surfactants include as part of their structure an ethylenediamine moiety, an alkanolamide moiety, an amino acid moiety, e.g., glycine, or a combination thereof; and an aliphatic substituent of from about 8 to 18 (e.g., 12) carbon atoms. Such a surfactant can also be considered an alkyl amphodicarboxylic acid. These amphoteric surfactants can include chemical structures represented as: $C_{12}$-alkyl-C(O)—NH—$CH_2$—$CH_2$—$N^+(CH_2—CH_2—CO_2Na)_2$—$CH_2$—$CH_2$—OH or $C_{12}$-alkyl-C(O)—N(H)—$CH_2$—$CH_2$—$N^+(CH_2—CO_2Na)_2$—$CH_2$—$CH_2$—OH. Disodium cocoampho dipropionate is one suitable amphoteric surfactant and is commercially available under the tradename Miranol™ FBS from Rhodia Inc., Cranbury, N.J. Another suitable coconut derived amphoteric surfactant with the chemical name disodium cocoampho diacetate is sold under the tradename Mirataine™ JCHA, also from Rhodia Inc., Cranbury, N.J. A typical listing of amphoteric classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch), which is herein incorporated by reference in its entirety.

Cationic Surfactants

Surface active substances are classified as cationic if the charge on the hydrotrope portion of the molecule is positive. Surfactants in which the hydrotrope carries no charge unless the pH is lowered close to neutrality or lower, but which are then cationic (e.g. alkyl amines), are also included in this group. In theory, cationic surfactants may be synthesized from any combination of elements containing an "onium" structure RnX+Y— and could include compounds other than nitrogen (ammonium) such as phosphorus (phosphonium) and sulfur (sulfonium). In practice, the cationic surfactant field is dominated by nitrogen containing compounds, probably because synthetic routes to nitrogenous cationics are simple and straightforward and give high yields of product, which can make them less expensive.

Cationic surfactants preferably include, more preferably refer to, compounds containing at least one long carbon chain hydrophobic group and at least one positively charged nitrogen. The long carbon chain group may be attached directly to the nitrogen atom by simple substitution; or more preferably indirectly by a bridging functional group or groups in so-called interrupted alkylamines and amido amines. Such functional groups can make the molecule more hydrophilic and/or more water dispersible, more easily water solubilized by co-surfactant mixtures, and/or water soluble. For increased water solubility, additional primary, secondary or tertiary amino groups can be introduced or the amino nitrogen can be quaternized with low molecular weight alkyl groups. Further, the nitrogen can be a part of branched or straight chain moiety of varying degrees of unsaturation or of a saturated or unsaturated heterocyclic ring. In addition, cationic surfactants may contain complex linkages having more than one cationic nitrogen atom.

The surfactant compounds classified as amine oxides, amphoterics and zwitterions are themselves typically cationic in near neutral to acidic pH solutions and can overlap surfactant classifications. Polyoxyethylated cationic surfactants generally behave like nonionic surfactants in alkaline solution and like cationic surfactants in acidic solution. The simplest cationic amines, amine salts and quaternary ammonium compounds can be schematically drawn thus:

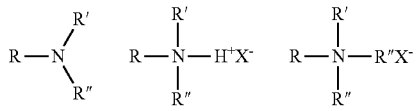

in which, R represents a long alkyl chain, R', R", and R'" may be either long alkyl chains or smaller alkyl or aryl groups or hydrogen and X represents an anion. The amine salts and quaternary ammonium compounds are preferred for practical use in this invention due to their high degree of water solubility. The majority of large volume commercial cationic surfactants can be subdivided into four major classes and additional sub-groups known to those or skill in the art and described in "Surfactant Encyclopedia", Cosmetics & Toiletries, Vol. 104 (2) 86-96 (1989), which is herein incorporated by reference in its entirety. The first class includes alkylamines and their salts. The second class includes alkyl imidazolines. The third class includes ethoxylated amines. The fourth class includes quaternaries, such as alkylbenzyldimethylammonium salts, alkyl benzene salts, heterocyclic ammonium salts, tetra alkylammonium salts, and the like. Cationic surfactants are known to have a variety of properties that can be beneficial in the present compositions. These desirable properties can include detergency in compositions of or below neutral pH, antimicrobial efficacy, thickening or gelling in cooperation with other agents, and the like. Cationic surfactants useful in the compositions of the present invention include those having the formula R1mR2xYLZ wherein each R1 is an organic group containing a straight or branched alkyl or alkenyl group optionally substituted with up to three phenyl or hydroxy groups and optionally interrupted by up to four of the following structures:

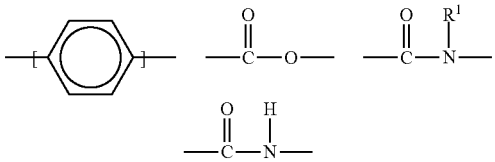

or an isomer or mixture of these structures, and which contains from about 8 to 22 carbon atoms. The R1 groups can additionally contain up to 12 ethoxy groups. m is a number from 1 to 3. Preferably, no more than one R1 group in a molecule has 16 or more carbon atoms when m is 2 or more than 12 carbon atoms when m is 3. Each R2 is an alkyl or hydroxyalkyl group containing from 1 to 4 carbon atoms or a benzyl group with no more than one R2 in a molecule being benzyl, and x is a number from 0 to 11, preferably from 0 to 6. The remainder of any carbon atom positions on the Y group are filled by hydrogens. Y is can be a group including, but not limited to:

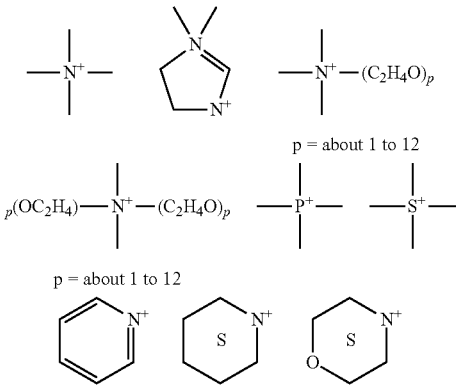

or a mixture thereof. Preferably, L is 1 or 2, with the Y groups being separated by a moiety selected from R1 and R2 analogs (preferably alkylene or alkenylene) having from 1 to about 22 carbon atoms and two free carbon single bonds when L is 2. Z is a water soluble anion, such as a halide, sulfate, methylsulfate, hydroxide, or nitrate anion, particularly preferred being chloride, bromide, iodide, sulfate or methyl sulfate anions, in a number to give electrical neutrality of the cationic component.

Zwitterionic Surfactants

Zwitterionic surfactants can be thought of as a subset of the amphoteric surfactants and can include an anionic charge. Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. Typically, a zwitterionic surfactant includes a positive charged quaternary ammonium or, in some cases, a sulfonium or phosphonium ion; a negative charged carboxyl group; and an alkyl group. Zwitterionics generally contain cationic and anionic groups which ionize to a nearly equal degree in the isoelectric region of the molecule and which can develop strong "inner-salt" attraction between positive-negative charge centers. Examples of such zwitterionic synthetic surfactants include derivatives of aliphatic quaternary ammonium, phosphonium, and sulfonium compounds, in which the aliphatic radicals can be straight chain or branched, and wherein one of the aliphatic substituents contains from 8 to 18 carbon atoms and one contains an anionic water solubilizing group, e.g., carboxy, sulfonate, sulfate, phosphate, or phosphonate.

Betaine and sultaine surfactants are exemplary zwitterionic surfactants for use herein. A general formula for these compounds is:

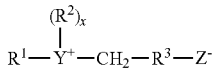

wherein $R^1$ contains an alkyl, alkenyl, or hydroxyalkyl radical of from 8 to 18 carbon atoms having from 0 to 10 ethylene oxide moieties and from 0 to 1 glyceryl moiety; Y is selected from the group consisting of nitrogen, phosphorus, and sulfur atoms; $R^2$ is an alkyl or monohydroxy alkyl group containing 1 to 3 carbon atoms; x is 1 when Y is a sulfur atom and 2 when Y is a nitrogen or phosphorus atom, $R^3$ is an alkylene or hydroxy alkylene or hydroxy alkylene of from 1 to 4 carbon atoms and Z is a radical selected from the group consisting of carboxylate, sulfonate, sulfate, phosphonate, and phosphate groups.

Examples of zwitterionic surfactants having the structures listed above include: 4-[N,N-di(2-hydroxyethyl)-N-octadecylammonio]-butane-1-carboxylate; 5-[S-3-hydroxypropyl-S-hexadecylsulfonio]-3-hydroxypentane-1-sulfate; 3-[P,P-diethyl-P-3,6,9-trioxatetracosanephosphonio]-2-hydroxypropane-1-phosphate; 3-[N,N-dipropyl-N-3-dodecoxy-2-hydroxypropyl-ammonio]-propane-1-phosphonate; 3-(N,N-dimethyl-N-hexadecylammonio)-propane-1-sulfonate; 3-(N,N-dimethyl-N-hexadecylammonio)-2-hydroxy-propane-1-sulfonate; 4-[N,N-di(2(2-hydroxyethyl)-N(2-hydroxydodecyl)ammonio]-butane-1-carboxylate; 3-[S-ethyl-S-(3-dodecoxy-2-hydroxypropyl)sulfonio]-propane-1-phosphate; 3-[P,P-dimethyl-P-dodecylphosphonio]-propane-1-phosphonate; and S[N,N-di(3-hydroxypropyl)-N-hexadecylammonio]-2-hydroxy-pentane-1-sulfate. The alkyl groups contained in said detergent surfactants can be straight or branched and saturated or unsaturated.

The zwitterionic surfactant suitable for use in the present compositions includes a betaine of the general structure:

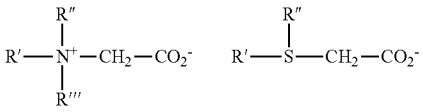

-continued

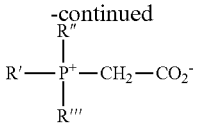

These surfactant betaines typically do not exhibit strong cationic or anionic characters at pH extremes nor do they show reduced water solubility in their isoelectric range. Unlike "external" quaternary ammonium salts, betaines are compatible with anionics. Examples of suitable betaines include coconut acylamidopropyldimethyl betaine; hexadecyl dimethyl betaine; $C_{12-14}$ acylamidopropylbetaine; $C_{8-14}$ acylamidohexyldiethyl betaine; 4-$C_{14-16}$ acylmethylamidodiethylammonio-1-carboxybutane; $C_{16-18}$ acylamidodimethylbetaine; $C_{12-16}$ acylamidopentanediethylbetaine; and $C_{12-16}$ acylmethylamidodimethylbetaine.

Sultaines useful in the present invention include those compounds having the formula $(R(R^1)_2\ N^+\ R^2SO^{3-}$, in which R is a $C_6$-$C_{18}$ hydrocarbyl group, each $R^1$ is typically independently $C_1$-$C_3$ alkyl, e.g. methyl, and $R^2$ is a $C_1$-$C_6$ hydrocarbyl group, e.g. a $C_1$-$C_3$ alkylene or hydroxyalkylene group.

A typical listing of zwitterionic classes, and species of these surfactants, is given in U.S. Pat. No. 3,929,678, which is herein incorporated by reference in its entirety. Further examples are given in "Surface Active Agents and Detergents" (Vol. I and II by Schwartz, Perry and Berch), which is herein incorporated by reference in its entirety.

Detergent Builders

The composition can include one or more building agents, also called chelating or sequestering agents (e.g., builders), including, but not limited to: condensed phosphates, alkali metal carbonates, phosphonates, aminocarboxylic acids, aminocarboxylates and their derivatives, ethylenediamine and ethylenetriamine derivatives, hydroxyacids, and mono-, di-, and tri-carboxylates and their corresponding acids, and/or polyacrylates. In general, a chelating agent is a molecule capable of coordinating (i.e., binding) the metal ions commonly found in natural water to prevent the metal ions from interfering with the action of the other detersive ingredients of a cleaning composition. In a preferred embodiment, the detergent composition does not comprise a phosphate builder.

Other chelating agents include nitroloacetates and their derivatives, and mixtures thereof. Examples of aminocarboxylates include amino acetates and salts thereof. Suitable amino acetates include: N-hydroxyethylaminodiacetic acid; hydroxyethylenediaminetetraacetic acid; nitrilotriacetic acid (NTA); ethylenediaminetetraacetic acid (EDTA); N-hydroxyethyl-ethylenediaminetriacetic acid (HEDTA); tetrasodium ethylenediaminetetraacetic acid (EDTA); diethylenetriaminepentaacetic acid (DTPA); and alanine-N,N-diacetic acid; n-hydroxyethyliminodiacetic acid; and the like; their alkali metal salts; and mixtures thereof. Suitable aminophosphates include nitrilotrismethylene phosphates and other aminophosphates with alkyl or alkaline groups with less than 8 carbon atoms. Exemplary polycarboxylates iminodisuccinic acids (IDS), sodium polyacrylates, citric acid, gluconic acid, oxalic acid, salts thereof, mixtures thereof, and the like. Additional polycarboxylates include citric or citrate-type chelating agents, polymeric polycarboxylate, and acrylic or polyacrylic acid-type chelating agents. Additional chelating agents include polyaspartic acid or co-condensates of aspartic acid with other amino acids, $C_4$-$C_{25}$-mono-or-dicarboxylic acids and $C_4$-$C_{25}$-mono-or-diamines. Exemplary polymeric polycarboxylates include polyacrylic acid, maleic/olefin copolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, hydrolyzed acrylonitrile-methacrylonitrile copolymers, and the like.

Useful aminocarboxylic acid materials containing little or no NTA include, but are not limited to: N-hydroxyethylaminodiacetic acid, ethylenediaminetetraacetic acid (EDTA), hydroxyethylenediaminetetraacetic acid, diethylenetriaminepentaacetic acid, N-hydroxyethyl-ethylenediaminetriacetic acid (HEDTA), diethylenetriaminepentaacetic acid (DTPA), methylglycinediacetic acid (MGDA), glutamic acid-N,N-diacetic acid (GLDA), ethylenediaminesuccinic acid (EDDS), 2-hydroxyethyliminodiacetic acid (HEIDA), iminodisuccinic acid (IDS), 3-hydroxy-2-2'-iminodisuccinic acid (HIDS) and other similar acids or salts thereof having an amino group with a carboxylic acid substituent.

In a preferred aspect, the chelant is gluconic acid, EDTA or an alkali metal salt thereof.

Preferable levels of addition for builders that can also be chelating or sequestering agents are between about 0.001% to about 70% by weight, about 0.001% to about 60% by weight, or about 0.01% to about 50% by weight. If the composition is provided as a concentrate, the concentrate can include between approximately 0.001% to approximately 50% by weight, between approximately 0.001% to approximately 35% by weight, and between approximately 0.001% to approximately 30% by weight of the builders.

Oxidizer

An oxidizing agents for use in the detergent compositions may also be included, and may be referred to as a bleaching agent as it may provide lightening or whitening of a substrate. An oxidizer may include bleaching compounds capable of liberating an active halogen species, such as $Cl_2$, $Br_2$., —OCl and/or —OBr—, under conditions typically encountered during the cleansing process. Suitable bleaching agents for use in the present detergent compositions include, for example, chlorine-containing compounds such as a chlorine, a hypochlorite (e.g. sodium hypochlorite), and/or chloramine. Preferred halogen-releasing compounds include the alkali metal dichloroisocyanurates, such as sodium dichloroisocyanurate, chlorinated trisodium phosphate, the alkali metal hypochlorites, monochloramine and dichloramine, and the like. An oxidizer may also be a peroxygen or active oxygen source such as hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine, and the like.

A detergent composition may include a minor but effective amount of an oxidizer, preferably about 0.1-30 wt-%, and more preferably from about 1-15 wt-%. In a preferred aspect, the oxidizer is a alkali metal hypochlorite.

Sanitizing Rinse Aid Compositions

The sanitizing rinse aid formulations employed according to the present invention provide a single dual formulation of a concentrated equilibrium peroxycarboxylic acid compositions with rinse aid surfactants to allow a single formulation (i.e. one part system) instead of the separate products for cleaning, sanitizing and/or rinsing which are customarily used in ware washing and other cleaning and/or sanitizing applications. Various advantages of the sanitizing rinse aid compositions are disclosed in U.S. application Ser. No. 13/863,001, which is herein incorporated by reference in its entirety.

In an aspect, the single use, dual compositions include concentrated equilibrium compositions comprising peroxycarboxylic acid(s), hydrogen peroxide, corresponding carboxylic acid(s), a solvent, e.g., water, rinse aid surfactants, and other optional additional functional ingredients. In an aspect, the concentrated, equilibrium liquid sanitizing rinse aid compositions include the exemplary ranges shown in Table 3.

TABLE 3

| | Formulations | | |
|---|---|---|---|
| Solvent (e.g. Water) | 0-80 wt-% | 0.001-60 wt-% | 0.01-50 wt-% |
| Peroxycarboxylic Acid | 0.1-40 wt-% | 1-20 wt-% | 1-10 wt-% |
| Carboxylic Acid | 0.1-80 wt-% | 1-40 wt-% | 1-15 wt-% |
| Hydrogen Peroxide | 1-75 wt-% | 1-50 wt-% | 1-25 wt-% |
| Rinse Aid Surfactants (defoaming and wetting surfactants) | 1-50 wt-% | 1-25 wt-% | 10-25 wt-% |
| Additional Functional Ingredients | 0-50 wt-% | 1-50 wt-% | 10-50 wt-% |

According to the invention, the concentrated, equilibrium compositions set forth in Table 3 provide acidic pHs, such as from about 0 to about 4. However, according to aspects of the invention, the diluted use solutions may have acidic or neutral to alkaline pH depending upon a particular application of use thereof. In one aspect, the pH of the use solution of the compositions is between about 0 to about 4. In a further aspect, the pH of the use solution of the compositions is between about 5 to about 9, preferably from about 5.5 to about 8.5. Without limiting the scope of invention, the numeric ranges are inclusive of the numbers defining the range and include each integer within the defined range.

In additional aspects, the concentrated, equilibrium compositions set forth in Table 3 are suitable for dilution and use at temperatures up to about 100° F., up to about 110° F., up to about 120° F., up to about 180° F., at temperatures from about 100° F. to about 140° F., at temperatures above about 140° F., and at temperatures up to or above 180° F. Without limiting the scope of invention, the numeric ranges are inclusive of the numbers defining the range and include each integer within the defined range.

It is unexpected according to certain embodiments of the compositions and methods of the invention that the use solutions of neutral to alkaline pH (e.g. about 5-9) provide micro efficacy against pathogenic organisms, including for example gram negative organisms important for food safety sanitizing applications. This is unexpected as a neutral pH POOA sanitizing composition was expected to have ineffective antimicrobial efficacy against *E. coli* or other gram negative organisms even at elevated temperatures (e.g., 100° F.-140° F., such as those temperatures currently required for chemical sanitization with bleach in ware wash machines). This is evident by the use of peroxycarboxylic acids, such as the medium length alkyl chain peracid in use solutions having acidic pH (generally pH of less than <4.0) to provide sufficient sanitizing efficacy against gram negative organisms, such as *E. coli*.

In additional aspects, the concentrated, equilibrium compositions set forth in Table 3 are low odor products. In preferred aspects, the concentrated equilibrium compositions include less than about 2 wt-% peroxyacetic acid, or preferably exclude peroxyacetic acid. In other aspects, the concentrated, equilibrium compositions contain short chain carboxylic acids (and corresponding peroxycarboxylic acids) at a level insufficient to cause odor offensive to a typical person. In certain embodiments, the present concentrated compositions include, for example, less than 10 wt-%, less than less than 5 wt-%, less than 2 wt-%, or less than 1 wt-% acetic acid or other malodor-causing short chain carboxylic acids.

The sanitizing rinse aid compositions may include concentrate compositions or may be diluted to form use compositions. In general, a concentrate refers to a composition that is intended to be diluted with water to provide a use solution that contacts an object to provide the desired cleaning, rinsing, or the like. The sanitizing rinse aid composition that contacts the articles to be washed can be referred to as a concentrate or a use composition (or use solution) dependent upon the formulation employed in methods according to the invention.

A use solution may be prepared from the concentrate by diluting the concentrate with water at a dilution ratio that provides a use solution having desired sanitizing and rinsing properties. The water that is used to dilute the concentrate to form the use composition can be referred to as water of dilution or a diluent, and can vary from one location to another. The typical dilution factor is between approximately 1 and approximately 10,000 but will depend on factors including water hardness, the amount of soil to be removed from treated surfaces and the like. In an embodiment, the concentrate is diluted at a ratio of between about 1:10 and about 1:10,000 concentrate to water. Particularly, the concentrate is diluted at a ratio of between about 1:100 and about 1:5,000 concentrate to water. Without limiting the scope of invention, the numeric ranges are inclusive of the numbers defining the range and include each integer within the defined range.

The methods of making or formulating the sanitizing rinse aid compositions according to the invention may include combining the nonionic surfactants, carboxylic acids and hydrogen peroxide with the other materials disclosed herein. The compositions can also be formulated with preformed peroxycarboxylic acids. However, preferably the compositions are made by mixing the carboxylic acid or mixture thereof with the hydrogen peroxide to react the mixture and adding the balance of required ingredients to form the sanitizing rinse aid compositions. Exemplary methods are disclosed for example in U.S. Pat. No. 7,887,641, which is herein incorporated by reference in its entirety. Thereafter, a stable equilibrium mixture is produced containing the carboxylic acid(s) with hydrogen peroxide and allowing the mixture to stand for 1-7 days (or greater).

Peroxycarboxylic Acids

According to the invention, a peroxycarboxylic acid (i.e. peracid) is included for antimicrobial efficacy in the sanitizing and rinsing compositions disclosed herein. As used herein, the term "peracid" may also be referred to as a "percarboxylic acid," "peroxycarboxylic acid" or "peroxyacid." Sulfoperoxycarboxylic acids, sulfonated peracids and sulfonated peroxycarboxylic acids are also included within the terms "peroxycarboxylic acid," "peracid" and others used herein. The terms "sulfoperoxycarboxylic acid," "sulfonated peracid," or "sulfonated peroxycarboxylic acid" refers to the peroxycarboxylic acid form of a sulfonated carboxylic acid as disclosed in U.S. Pat. No. 8,344,026, and U.S. Patent Publication Nos. 2010/0048730 and 2012/

0052134, each of which are incorporated herein by reference in their entirety. As one of skill in the art appreciates, a peracid refers to an acid having the hydrogen of the hydroxyl group in carboxylic acid replaced by a hydroxy group. Oxidizing peracids may also be referred to herein as peroxycarboxylic acids.

A peracid includes any compound of the formula R—(COOOH)$_n$ in which R can be hydrogen, alkyl, alkenyl, alkyne, acylic, alicyclic group, aryl, heteroaryl, or heterocyclic group, and n is 1, 2, or 3, and named by prefixing the parent acid with peroxy. Preferably R includes hydrogen, alkyl, or alkenyl. The terms "alkyl," "alkenyl," "alkyne," "acylic," "alicyclic group," "aryl," "heteroaryl," and "heterocyclic group" are as defined herein.

As used herein, the term "alkyl" or "alkyl groups" refers to saturated hydrocarbons having one or more carbon atoms, including straight-chain alkyl groups (e.g., methyl, ethyl, propyl, butyl, pentyl, hexyl, heptyl, octyl, nonyl, decyl, etc.), cyclic alkyl groups (or "cycloalkyl" or "alicyclic" or "carbocyclic" groups) (e.g., cyclopropyl, cyclopentyl, cyclohexyl, cycloheptyl, cyclooctyl, etc.), branched-chain alkyl groups (e.g., isopropyl, tert-butyl, sec-butyl, isobutyl, etc.), and alkyl-substituted alkyl groups (e.g., alkyl-substituted cycloalkyl groups and cycloalkyl-substituted alkyl groups). Preferably, a straight or branched saturated aliphatic hydrocarbon chain having from 1 to 22 carbon atoms, such as, for example, methyl, ethyl, propyl, isopropyl (1-methylethyl), butyl, tert-butyl (1,1-dimethylethyl), and the like.

Unless otherwise specified, the term "alkyl" includes both "unsubstituted alkyls" and "substituted alkyls." As used herein, the term "substituted alkyls" refers to alkyl groups having substituents replacing one or more hydrogens on one or more carbons of the hydrocarbon backbone. Such substituents may include, for example, alkenyl, alkynyl, halogeno, hydroxyl, alkylcarbonyloxy, arylcarbonyloxy, alkoxycarbonyloxy, aryloxy, aryloxycarbonyloxy, carboxylate, alkylcarbonyl, arylcarbonyl, alkoxycarbonyl, aminocarbonyl, alkylaminocarbonyl, dialkylaminocarbonyl, alkylthiocarbonyl, alkoxyl, phosphate, phosphonato, phosphinato, cyano, amino (including alkyl amino, dialkylamino, arylamino, diarylamino, and alkylarylamino), acylamino (including alkylcarbonylamino, arylcarbonylamino, carbamoyl and ureido), imino, sulfhydryl, alkylthio, arylthio, thiocarboxylate, sulfates, alkylsulfinyl, sulfonates, sulfamoyl, sulfonamido, nitro, trifluoromethyl, cyano, azido, heterocyclic, alkylaryl, or aromatic (including heteroaromatic) groups.

The term "alkenyl" includes an unsaturated aliphatic hydrocarbon chain having from 2 to 12 carbon atoms, such as, for example, ethenyl, 1-propenyl, 2-propenyl, 1-butenyl, 2-methyl-1-propenyl, and the like. The alkyl or alkenyl can be terminally substituted with a heteroatom, such as, for example, a nitrogen, sulfur, or oxygen atom, forming an aminoalkyl, oxyalkyl, or thioalkyl, for example, aminomethyl, thioethyl, oxypropyl, and the like. Similarly, the above alkyl or alkenyl can be interrupted in the chain by a heteroatom forming an alkylaminoalkyl, alkylthioalkyl, or alkoxyalkyl, for example, methylaminoethyl, ethylthiopropyl, methoxymethyl, and the like.

Further, as used herein the term "alicyclic" includes any cyclic hydrocarbyl containing from 3 to 8 carbon atoms. Examples of suitable alicyclic groups include cyclopropanyl, cyclobutanyl, cyclopentanyl, etc. In some embodiments, substituted alkyls can include a heterocyclic group. As used herein, the term "heterocyclic group" includes closed ring structures analogous to carbocyclic groups in which one or more of the carbon atoms in the ring is an element other than carbon, for example, nitrogen, sulfur or oxygen. Heterocyclic groups may be saturated or unsaturated. Exemplary heterocyclic groups include, but are not limited to, aziridine, ethylene oxide (epoxides, oxiranes), thiirane (episulfides), dioxirane, azetidine, oxetane, thietane, dioxetane, dithietane, dithiete, azolidine, pyrrolidine, pyrroline, oxolane, dihydrofuran, and furan. Additional examples of suitable heterocyclic groups include groups derived from tetrahydrofurans, furans, thiophenes, pyrrolidines, piperidines, pyridines, pyrrols, picoline, coumaline, etc.

According to the invention, alkyl, alkenyl, alicyclic groups, and heterocyclic groups can be unsubstituted or substituted by, for example, aryl, heteroaryl, $C_{1-4}$ alkyl, $C_{1-4}$ alkenyl, $C_{1-4}$ alkoxy, amino, carboxy, halo, nitro, cyano, —$SO_3H$, phosphono, or hydroxy. When alkyl, alkenyl, alicyclic group, or heterocyclic group is substituted, preferably the substitution is $C_{1-4}$ alkyl, halo, nitro, amido, hydroxy, carboxy, sulpho, or phosphono. In one embodiment, R includes alkyl substituted with hydroxy. The term "aryl" includes aromatic hydrocarbyl, including fused aromatic rings, such as, for example, phenyl and naphthyl. The term "heteroaryl" includes heterocyclic aromatic derivatives having at least one heteroatom such as, for example, nitrogen, oxygen, phosphorus, or sulfur, and includes, for example, furyl, pyrrolyl, thienyl, oxazolyl, pyridyl, imidazolyl, thiazolyl, isoxazolyl, pyrazolyl, isothiazolyl, etc. The term "heteroaryl" also includes fused rings in which at least one ring is aromatic, such as, for example, indolyl, purinyl, benzofuryl, etc.

According to the invention, aryl and heteroaryl groups can be unsubstituted or substituted on the ring by, for example, aryl, heteroaryl, alkyl, alkenyl, alkoxy, amino, carboxy, halo, nitro, cyano, —$SO_3H$, phosphono, or hydroxy. When aryl, aralkyl, or heteroaryl is substituted, preferably the substitution is $C_{1-4}$ alkyl, halo, nitro, amido, hydroxy, carboxy, sulpho, or phosphono. In one embodiment, R includes aryl substituted with $C_{1-4}$ alkyl.

Peracids suitable for use include any peroxycarboxylic acids, including varying lengths of peroxycarboxylic acids (e.g., C1-22) that can be prepared from the acid-catalyzed equilibrium reaction between a carboxylic acid described above and hydrogen peroxide. A peroxycarboxylic acid can also be prepared by the auto-oxidation of aldehydes or by the reaction of hydrogen peroxide with an acid chloride, acid hydride, carboxylic acid anhydride, sodium alcoholate or alkyl and aryl esters. Alternatively, peracids can be prepared through non-equilibrium reactions, which may be generated for use in situ, such as the methods disclosed in U.S. Patent Publication Nos. 2012/0172440 and 2012/0172441 each titled "In Situ Generation of Peroxycarboxylic Acids at Alkaline pH, and Methods of Use Thereof," which are incorporated herein by reference in their entirety. Preferably a composition of the invention includes peroxyacetic acid, peroxyoctanoic acid, peroxypropionic acid, peroxylactic acid, peroxyheptanoic acid, peroxyoctanoic acid and/or peroxynonanoic acid.

In some embodiments, a peroxycarboxylic acid includes at least one water-soluble peroxycarboxylic acid in which R includes alkyl of 1-22 carbon atoms. For example, in one embodiment, a peroxycarboxylic acid includes peroxyacetic acid. In another embodiment, a peroxycarboxylic acid has R that is an alkyl of 1-22 carbon atoms substituted with a hydroxyl group or other polar substituent such that the substituent improves the water solubility. Methods of preparing peroxyacetic acid are known to those of skill in the art including those disclosed in U.S. Pat. No. 2,833,813, which is herein incorporated herein by reference in its entirety. In other embodiments, the peroxycarboxylic may be a combination of a short chain peroxycarboxylic acid, including for example peroxyacetic acid and/or a medium chain peroxycarboxylic acid, including for example those disclosed in U.S. Pat. No. 7,887,641, which is herein incorporated by reference in its entirety.

The peroxycarboxylic acid when formed in situ generally follows the reaction of hydrogen peroxide with the carboxylic acid (e.g., octanoic acid or mixture of octanoic acid and acetic acid) as shown below. This reaction is reversible and depending on the pH, water content, and storage temperature, the reaction may take from several hours to several days to reach equilibrium.

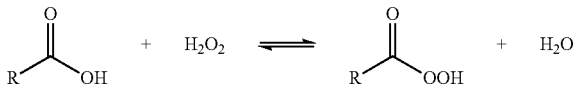

R = $CH_3$ = peroxyacetic acid (POAA)
R = $C_7H_{15}$ = peroxyoctanoic acid (POOA)

In another embodiment, a sulfoperoxycarboxylic acid has the following formula:

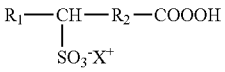

wherein $R_1$ is hydrogen, or a substituted or unsubstituted alkyl group; $R_2$ is a substituted or unsubstituted alkylene group; X is hydrogen, a cationic group, or an ester forming moiety; or salts or esters thereof. In some embodiments, $R_1$ is a substituted or unsubstituted Cm alkyl group; X is hydrogen a cationic group, or an ester forming moiety; $R_2$ is a substituted or unsubstituted $C_n$ alkyl group; m=1 to 10; n=1 to 10; and m+n is less than 18, or salts, esters or mixtures thereof.

In some embodiments, $R_1$ is hydrogen. In other embodiments, $R_1$ is a substituted or unsubstituted alkyl group. In some embodiments, $R_1$ is a substituted or unsubstituted alkyl group that does not include a cyclic alkyl group. In some embodiments, $R_1$ is a substituted alkyl group. In some embodiments, $R_1$ is an unsubstituted $C_1$-$C_9$ alkyl group. In some embodiments, $R_1$ is an unsubstituted $C_7$ or $C_8$ alkyl. In other embodiments, $R_1$ is a substituted $C_8$-$C_{10}$ alkylene group. In some embodiments, $R_1$ is a substituted $C_8$-$C_{10}$ alkyl group is substituted with at least 1, or at least 2 hydroxyl groups. In still yet other embodiments, $R_1$ is a substituted $C_1$-$C_9$ alkyl group. In some embodiments, $R_1$ is a substituted $C_1$-$C_9$ substituted alkyl group is substituted with at least 1 $SO_3H$ group. In other embodiments, $R_1$ is a $C_9$-$C_{10}$ substituted alkyl group. In some embodiments, $R_1$ is a substituted $C_9$-$C_{10}$ alkyl group wherein at least two of the carbons on the carbon backbone form a heterocyclic group. In some embodiments, the heterocyclic group is an epoxide group.

In some embodiments, $R_2$ is a substituted $C_1$-$C_{10}$ alkylene group. In some embodiments, $R_2$ is a substituted $C_8$-$C_{10}$ alkylene. In some embodiments, $R_2$ is an unsubstituted $C_6$-$C_9$ alkylene. In other embodiments, $R_2$ is a $C_8$-$C_{10}$ alkylene group substituted with at least one hydroxyl group. In some embodiments, $R_2$ is a $C_{10}$ alkylene group substituted with at least two hydroxyl groups. In other embodiments, $R_2$ is a $C_8$ alkylene group substituted with at least one $SO_3H$ group. In some embodiments, $R_2$ is a substituted $C_9$ group, wherein at least two of the carbons on the carbon backbone form a heterocyclic group. In some embodiments, the heterocyclic group is an epoxide group. In some embodiments, $R_1$ is a $C_8$-$C_9$ substituted or unsubstituted alkyl, and $R_2$ is a $C_7$-$C_8$ substituted or unsubstituted alkylene.

These and other suitable sulfoperoxycarboxylic acid compounds for use in the stabilized peroxycarboxylic acid compositions of the invention are further disclosed in U.S. Pat. No. 8,344,026 and U.S. Patent Publication Nos. 2010/0048730 and 2012/0052134, which are incorporated herein by reference in its entirety.

In additional embodiments a sulfoperoxycarboxylic acid is combined with a single or mixed peroxycarboxylic acid composition, such as a sulfoperoxycarboxylic acid with peroxyacetic acid and peroxyoctanoic acid (PSOA/POAA/POOA). In other embodiments, a mixed peracid is employed, such as a peroxycarboxylic acid including at least one peroxycarboxylic acid of limited water solubility in which R includes alkyl of 5-22 carbon atoms and at least one water-soluble peroxycarboxylic acid in which R includes alkyl of 1-4 carbon atoms. For example, in one embodiment, a peroxycarboxylic acid includes peroxyacetic acid and at least one other peroxycarboxylic acid such as those named above. Preferably a composition of the invention includes peroxyacetic acid and peroxyoctanoic acid, such as disclosed in U.S. Pat. No. 5,314,687 which is herein incorporated by reference in its entirety. In an aspect, the peracid mixture is a hydrophilic peracetic acid and a hydrophobic peroctanoic acid, providing antimicrobial synergy. In an aspect, the synergy of a mixed peracid system allows the use of lower dosages of the peracids.

In another embodiment, a tertiary peracid mixture composition, such as peroxysulfonated oleic acid, peracetic acid and peroctanoic acid are employed, such as disclosed in U.S. Pat. No. 8,344,026 which is incorporated herein by reference in its entirety. Advantageously, a combination of peroxycarboxylic acids provides a composition with desirable antimicrobial activity in the presence of high organic soil loads. The mixed peroxycarboxylic acid compositions often provide synergistic micro efficacy. Accordingly, compositions of the invention can include a peroxycarboxylic acid, or mixtures thereof.

Various commercial formulations of peracids are available, including for example peracetic acid (approximately 15%) available as EnviroSan or Victory (Ecolab, Inc., St. Paul Minn.). Most commercial peracid solutions state a specific percarboxylic acid concentration without reference to the other chemical components in a use solution. In preferred embodiments, the sanitizing rinse additive compositions exhibit low to no odor in the concentrated formulation. In a further preferred aspect, a low odor peracid is employed, such as peroxyoctanoic acid (POOA), to allow significantly increased concentration of the peracid in the sanitizing rinse aid composition without increasing the odor. According to some preferred embodiments, the peroxycarboxylic acid is not a peroxyacetic acid (containing the corresponding carboxylic acid acetic acid). According to other embodiments, the concentration of POAA in a concentrate composition is less than about 2 wt-%, and preferably less than about 1 wt-%.

In an aspect, any suitable $C_1$-$C_{22}$ percarboxylic acid can be used in the present compositions. In some embodiments, the $C_1$-$C_{22}$ percarboxylic acid is a $C_2$-$C_{20}$ percarboxylic acid. In other embodiments, the $C_1$-$C_{22}$ percarboxylic is a $C_1$, $C_2$, $C_3$, $C_4$, $C_5$, $C_6$, $C_7$, $C_8$, $C_9$, $C_{10}$, $C_{11}$, $C_{12}$, $C_{13}$, $C_{14}$, $C_{15}$, $C_{16}$, $C_{17}$, $C_{18}$, $C_{19}$, $C_{20}$, $C_{21}$, or $C_{22}$ carboxylic acid. In still other embodiments, the $C_1$-$C_{22}$ percarboxylic acid comprises peroxyacetic acid, peroxyoctanoic acid and/or peroxysulfonated oleic acid.

In an aspect of the invention, a peracid may be selected from a concentrated composition having a ratio of hydrogen peroxide to peracid from about 0:10 to about 10:0, preferably from about 0.5:10 to about 10:0.5, preferably from about 1:8 to 8:1. Various concentrated peracid compositions having the hydrogen peroxide to peracid ratios of about 0.5:10 to about 10:0.5, preferably from about 1:8 to 8:1, may be employed to produce a use solution for treatment according to the methods of the invention. In a further aspect of the invention, a peracid may have a ratio of hydrogen peroxide to peracid as low as from about 0.01 part hydrogen peroxide to about 1 part peracid. Without limiting the scope of invention, the numeric ranges are inclusive of the numbers defining the range and include each integer within the defined range.

In a preferred aspect, the $C_1$-$C_{22}$ percarboxylic acid can be used at any suitable concentration. In some embodiments, the $C_1$-$C_{22}$ percarboxylic acid has a concentration from about 0.1 wt-% to about 40 wt-% in a concentrated equilibrium composition. In other embodiments, the $C_1$-$C_{22}$ percarboxylic acid has a concentration from about 1 wt-% to about 40 wt-%, or from about 1 wt-% to about 20 wt-%. In still other embodiments, the $C_1$-$C_{22}$ percarboxylic acid has a concentration at about 1 wt-%, 2 wt-%, 3 wt-%, 4 wt-%, 5 wt-%, 6 wt-%, 7 wt-%, 8 wt-%, 9 wt-%, 10 wt-%, 11 wt-%, 12 wt-%, 13 wt-%, 14 wt-%, 15 wt-%, 16 wt-%, 17 wt-%, 18 wt-%, 19 wt-%, 20 wt-%, 25 wt-%, 30 wt-%, 35 wt-%, or 40 wt-%. Without limiting the scope of invention, the numeric ranges are inclusive of the numbers defining the range and include each integer within the defined range.

Carboxylic Acids

The present invention includes a carboxylic acid with the peracid composition and hydrogen peroxide. A carboxylic acid includes any compound of the formula $R—(COOH)_n$ in which R can be hydrogen, alkyl, alkenyl, alkyne, acylic, alicyclic group, aryl, heteroaryl, or heterocylic group, and n is 1, 2, or 3. Preferably R includes hydrogen, alkyl, or alkenyl. The terms "alkyl," "alkenyl," "alkyne," "acylic," "alicyclic group," "aryl," "heteroaryl," and "heterocyclic group" are as defined above with respect to peracids.

Examples of suitable carboxylic acids according to the equilibrium systems of peracids according to the invention include a variety monocarboxylic acids, dicarboxylic acids, and tricarboxylic acids. Monocarboxylic acids include, for example, formic acid, acetic acid, propanoic acid, butanoic acid, pentanoic acid, hexanoic acid, heptanoic acid, octanoic acid, nonanoic acid, decanoic acid, undecanoic acid, dodecanoic acid, glycolic acid, lactic acid, salicylic acid, acetylsalicylic acid, mandelic acid, etc. Dicarboxylic acids include, for example, adipic acid, fumaric acid, glutaric acid, maleic acid, succinic acid, malic acid, tartaric acid, etc. Tricarboxylic acids include, for example, citric acid, trimellitic acid, isocitric acid, agaicic acid, etc.

In an aspect of the invention, a particularly well suited carboxylic acid is water soluble such as formic acid, acetic acid, propionic acid, butanoic acid, lactic acid, glycolic acid, citric acid, mandelic acid, glutaric acid, maleic acid, malic acid, adipic acid, succinic acid, tartaric acid, etc. Preferably a composition of the invention includes acetic acid, octanoic acid, or propionic acid, lactic acid, heptanoic acid, octanoic acid, or nonanoic acid. Additional examples of suitable carboxylic acids are employed in sulfoperoxycarboxylic acid or sulfonated peracid systems, which are disclosed in U.S. Pat. No. 8,344,026, and U.S. Patent Publication Nos. 2010/0048730 and 2012/0052134, each of which are herein incorporated by reference in their entirety.

Any suitable $C_1$-$C_{22}$ carboxylic acid can be used in the present compositions. In some embodiments, the $C_1$-$C_{22}$ carboxylic acid is a $C_2$-$C_{20}$ carboxylic acid. In other embodiments, the $C_1$-$C_{22}$ carboxylic acid is a $C_1$, $C_2$, $C_3$, $C_4$, $C_5$, $C_6$, $C_7$, $C_8$, $C_9$, $C_{10}$, $C_{11}$, $C_{12}$, $C_{13}$, $C_{14}$, $C_{15}$, $C_{16}$, $C_{17}$, $C_{18}$, $C_{19}$, $C_{20}$, $C_{21}$, or $C_{22}$ carboxylic acid. In still other embodiments, the $C_1$-$C_{22}$ carboxylic acid comprises acetic acid, octanoic acid and/or sulfonated oleic acid.

The $C_1$-$C_{22}$ carboxylic acid can be used at any suitable concentration. In some embodiments, the $C_1$-$C_{22}$ carboxylic acid has a concentration in an equilibrium composition from about 0.1 wt-% to about 80 wt-%. In other embodiments, the $C_1$-$C_{22}$ carboxylic acid has a concentration from about 1 wt-% to about 80 wt-%. In still other embodiments, the $C_1$-$C_{22}$ carboxylic acid has a concentration at about 1 wt-% to about 40 wt-%, or preferably from about 1 wt-% to about 15 wt-%. Without limiting the scope of invention, the numeric ranges are inclusive of the numbers defining the range and include each integer within the defined range.

Oxidizing Agents

The present invention includes an oxidizing agent for the equilibrium peroxycarboxylic acid, such as hydrogen peroxide. Hydrogen peroxide, $H_2O_2$, provides the advantages of having a high ratio of active oxygen because of its low molecular weight (34.014 g/mole) and being compatible with numerous substances that can be treated by methods of the invention because it is a weakly acidic, clear, and colorless liquid. Another advantage of hydrogen peroxide is that it decomposes into water and oxygen. It is advantageous to have these decomposition products because they are generally compatible with substances being treated. For example, the decomposition products are generally compatible with metallic substance (e.g., substantially noncorrosive) and are generally innocuous to incidental contact and are environmentally friendly.

In one aspect of the invention, hydrogen peroxide is initially in an antimicrobial peracid composition in an amount effective for maintaining an equilibrium between a carboxylic acid, hydrogen peroxide, and a peracid. The amount of hydrogen peroxide should not exceed an amount that would adversely affect the antimicrobial activity of a composition of the invention. In further aspects of the invention, hydrogen peroxide concentration can be significantly reduced within an antimicrobial peracid composition. In some aspects, an advantage of minimizing the concentration of hydrogen peroxide is that antimicrobial activity of a composition of the invention is improved as compared to conventional equilibrium peracid compositions.

Beneficially, in some aspects of the invention, the sanitizing and rinsing compositions using equilibrium peracid compositions are not reliant and/or limited according to any particular ratio of hydrogen peroxide to peracid. In some embodiments the inclusion of a peracid stabilizing agent (e.g. DPA) is suitable for providing peracid stability under varying ratios of hydrogen peroxide to peracid.

The hydrogen peroxide can be used at any suitable concentration. In some embodiments, a concentrated equilibrium composition has a concentration of hydrogen peroxide from about 0.5 wt-% to about 90 wt-%, or from about 1 wt-% to about 90 wt-%. In still other embodiments, the hydrogen peroxide has a concentration from about 1 wt-% to about 80 wt-%, from about 1 wt-% to about 50 wt-%. Without limiting the scope of invention, the numeric ranges are inclusive of the numbers defining the range and include each integer within the defined range.

Surfactants

According to the invention, rinse aid surfactant(s) are included for rinsing efficacy in the sanitizing and rinsing compositions disclosed herein. The rinse aid surfactant(s) are required to provide rinse aid performance, including sheeting, spot- and film-free ware and quick drying performance in the presence of peroxycarboxylic acid and hydrogen peroxide. In further aspects, the rinse aid surfactant(s) provide antifoaming properties to overcome foam generated by agitation of machine sump solutions (e.g. such as those containing proteinaceous food soils). In some embodiments, the rinse aid surfactant(s) are stable and provide such rinse aid performance under acidic conditions and are accordingly referred to as acid-compatible.

In some embodiments, the compositions of the present invention include more than one rinse aid surfactant, and preferably include a combination of at least two rinse aid surfactants. In some embodiments a combination of surfactants is provided wherein one surfactant predominantly provides antifoaming properties, and wherein the second surfactant predominantly aids in sheeting and drying (i.e. wetting surfactant). Surfactants suitable for use with the compositions of the present invention include nonionic surfactants.

In some embodiments, the concentrated compositions of the present invention include about 10 wt-% to about 50 wt-% of a nonionic surfactant. In other embodiments the compositions of the present invention include about 10 wt-% to about 30 wt-% of a nonionic surfactant. In still yet other embodiments, the compositions of the present invention include about 10 wt-% to about 20 wt-% of a nonionic surfactant. In addition, without being limited according to the invention, all ranges are inclusive of the numbers defining the range and include each integer within the defined range.

In some aspects the ratio of the defoaming to wetting surfactants impacts the shelf-life of the sanitizing rinse aid composition according to the invention. In a further aspect, the ratio of the defoaming to wetting surfactants impacts the anti-foaming capabilities of the composition. According to the invention, in preferred aspects, the concentration of the defoaming surfactants exceeds the concentration of the wetting surfactant. In further aspects the ratio is from about 1:1 to about 100:1, preferably from about 1:1 to about 50:1. In some aspects the ratio of the defoaming surfactants to the wetting surfactants is from about 1.5:1 to about 10:1, preferably from about 2:1 to about 5:1. In addition, without being limited according to the invention, all ranges for the ratios recited are inclusive of the numbers defining the range and include each integer within the defined range of ratios. In an aspect, preferred nonionic surfactants for use as the defoaming surfactant include block polyoxypropylene-polyoxyethylene polymeric compounds such as alcohol-EO-PO nonionic surfactants. Exemplary alcohol-EO-PO nonionics are commercially available under the tradename Plurafac®. Without being limited to a particular theory of the invention, alcohol-EO-PO surfactants retain antifoaming properties longer than polyoxypropylene-polyoxyethylene polymeric compounds having an EOm-POn-EOm (wherein m is an integer between 1-200, and n is an integer between 1-100) type structure (such as those commercially-available under the tradename Pluronic®, manufactured by BASF Corp.) and compounds having an POm-EOn-POm (wherein m is an integer between 1-100, and n is an integer between 1-200) type structure (such as those commercially-available under the tradename Pluronic® R, also manufactured by BASF Corp.) due to the presence of the peroxycarboxylic acid and hydrogen peroxide in the formulations according to the invention.

A particularly useful group of alcohol alkoxylates are those having the general formula R-$(EO)_m$—$(PO)_n$, wherein m is an integer of about 1-20, preferably 1-10 and n is an integer of about 1-20, preferably 2-20, and wherein R is any suitable radical, including for example a straight chain alkyl group having from about 6-20 carbon atoms.

In a further aspect, preferred nonionic surfactants include capped or end blocked surfactants (wherein the terminal hydroxyl group (or groups)) is capped. In an embodiment, capped aliphatic alcohol alkoxylates include those having end caps including methyl, ethyl, propyl, butyl, benzyl and chlorine and may have a molecular weight of about 400 to about 10,000. Without being limited to a particular theory of the invention, capped nonionic surfactants provide improved stability over PO-EO-PO type or EO-PO-EO type structure nonionics (such as those commercially-available under the tradenames Pluronic® and Pluronic® R, manufactured by BASF Corp). According to the invention, the capping improves the compatibility between the nonionic surfactants and the oxidizing hydrogen peroxide and peroxycarboxylic acids when formulated into a single composition.

In a further aspect, preferred nonionic surfactants for use as the wetting surfactant include alkyl ethoxylates and/or alcohol ethoxylates. In some embodiments, the wetting agent includes one or more alcohol ethoxylate compounds that include an alkyl group that has 12 or fewer carbon atoms. For example, alcohol ethoxylate compounds for use in the sanitizing rinse aids of the present invention may each independently have structure represented by the following formula: R—O—$(CH_2CH_2O)_n$—H, wherein R is a $C_1$-$C_{16}$ alkyl group and n is an integer in the range of 1 to 100. In other embodiments, R may be a ($C_8$-$C_{12}$) alkyl group, or may be a ($C_8$-$C_{10}$) alkyl group. Similarly, in some embodiments, n is an integer in the range of 1-50, or in the range of 1-30, or in the range of 1-25. In some embodiments, the one or more alcohol ethoxylate compounds are straight chain hydrophobes. An example of such an alcohol ethoxylate wetting surfactant is commercially available from Sasol under the tradename NOVEL® 1012-21 GB.

Alkyl ethoxylate surfactants terminated with methyl, benzyl, and butyl "capping" groups are known, with the methyl and butyl capped versions being commercially available. However, the various alkyl ethoxylates can contain a significant amount of unprotected (i.e., uncapped) hydroxyl groups. Therefore, there is a preference for use of the alkyl ethoxylate surfactants to be capped to remove the reactivity of unprotected hydroxyl groups. In a further embodiment, the surfactant has only a single uncapped hydroxyl group, such as the following exemplary structures: Alkyl-(EO)m-(PO)n-POH and Alkyl-(EO)n-EOR, wherein R=alkyl (60-80%), R=H (20-40%), and wherein m is an integer in the range from 1 to 20 and n is an integer in the range from 1 to 20.

In some embodiments, the defoaming and wetting surfactants used can be chosen such that they have certain characteristics, for example, are environmentally friendly, are suitable for use in food service industries, and/or the like. For example, the particular alcohol ethoxylates used in the sheeting agent may meet environmental or food service regulatory requirements, for example, biodegradability requirements. In a preferred aspect, the nonionic surfactants employed in the sanitizing rinse aid compositions are approved by the U.S. EPA under CFR 180.940 for use in food contact sanitizers. Additional nonionic surfactants include:

1. Block polyoxypropylene-polyoxyethylene polymeric compounds based upon propylene glycol, ethylene glycol, glycerol, trimethylolpropane, and ethylenediamine as the initiator reactive hydrogen compound. Examples of polymeric compounds made from a sequential propoxylation and ethoxylation of initiator are commercially available under the trade names Pluronic® and Tetronic® manufactured by BASF Corp. Pluronic® compounds are difunctional (two reactive hydrogens) compounds formed by condensing ethylene oxide with a hydrophobic base formed by the addition of propylene oxide to the two hydroxyl groups of propylene glycol. This hydrophobic portion of the molecule weighs from about 1,000 to about 4,000. Ethylene oxide is then added to sandwich this hydrophobe between hydrophilic groups, controlled by length to constitute from about 10% by weight to about 80% by weight of the final molecule. Tetronic® compounds are tetra-functional block copolymers derived from the sequential addition of propylene oxide and ethylene oxide to ethylenediamine. The molecular weight of the propylene oxide hydrotype ranges from about 500 to about 7,000; and, the hydrophile, ethylene oxide, is added to constitute from about 10% by weight to about 80% by weight of the molecule.

2. Condensation products of one mole of alkyl phenol wherein the alkyl chain, of straight chain or branched chain configuration, or of single or dual alkyl constituent, contains from about 8 to about 18 carbon atoms with from about 3 to about 50 moles of ethylene oxide. The alkyl group can, for example, be represented by diisobutylene, di-amyl, polymerized propylene, iso-octyl, nonyl, and di-nonyl. These surfactants can be polyethylene, polypropylene, and polybutylene oxide condensates of alkyl phenols. Examples of commercial compounds of this chemistry are available on the market under the trade names Igepal® manufactured by Rhone-Poulenc and Triton® manufactured by Union Carbide.

3. Condensation products of one mole of a saturated or unsaturated, straight or branched chain alcohol having from about 6 to about 24 carbon atoms with from about 3 to about 50 moles of ethylene oxide. The alcohol moiety can consist of mixtures of alcohols in the above delineated carbon range or it can consist of an alcohol having a specific number of carbon atoms within this range. Examples of like commercial surfactant are available under the trade names Neodol™ manufactured by Shell Chemical Co. and Alfonic™ manufactured by Vista Chemical Co.

4. Condensation products of one mole of saturated or unsaturated, straight or branched chain carboxylic acid having from about 8 to about 18 carbon atoms with from about 6 to about 50 moles of ethylene oxide. The acid moiety can consist of mixtures of acids in the above defined carbon atoms range or it can consist of an acid having a specific number of carbon atoms within the range. Examples of commercial compounds of this chemistry are available on the market under the trade names Nopalcol™ manufactured by Henkel Corporation and Lipopeg™ manufactured by Lipo Chemicals, Inc.

In addition to ethoxylated carboxylic acids, commonly called polyethylene glycol esters, other alkanoic acid esters formed by reaction with glycerides, glycerin, and polyhydric (saccharide or sorbitan/sorbitol) alcohols have application in this invention for specialized embodiments, particularly indirect food additive applications. All of these ester moieties have one or more reactive hydrogen sites on their molecule which can undergo further acylation or ethylene oxide (alkoxide) addition to control the hydrophilicity of these substances. Care must be exercised when adding these fatty ester or acylated carbohydrates to compositions of the present invention containing amylase and/or lipase enzymes because of potential incompatibility.

Examples of nonionic low foaming surfactants include:

5. Compounds from (1) which are modified, essentially reversed, by adding ethylene oxide to ethylene glycol to provide a hydrophile of designated molecular weight; and, then adding propylene oxide to obtain hydrophobic blocks on the outside (ends) of the molecule. The hydrophobic portion of the molecule weighs from about 1,000 to about 3,100 with the central hydrophile including 10% by weight to about 80% by weight of the final molecule. These reverse Pluronics™ are manufactured by BASF Corporation under the trade name Pluronic™ R surfactants. Likewise, the Tetronic™ R surfactants are produced by BASF Corporation by the sequential addition of ethylene oxide and propylene oxide to ethylenediamine. The hydrophobic portion of the molecule weighs from about 2,100 to about 6,700 with the central hydrophile including 10% by weight to 80% by weight of the final molecule.

6. Compounds from groups (1), (2), (3) and (4) which are modified by "capping" or "end blocking" the terminal hydroxy group or groups (of multi-functional moieties) to reduce foaming by reaction with a small hydrophobic molecule such as propylene oxide, butylene oxide, benzyl chloride; and, short chain fatty acids, alcohols or alkyl halides containing from 1 to about 5 carbon atoms; and mixtures thereof. Also included are reactants such as thionyl chloride which convert terminal hydroxy groups to a chloride group. Such modifications to the terminal hydroxy group may lead to all-block, block-heteric, heteric-block or all-heteric nonionics.

Additional examples of effective low foaming nonionics include:

7. The alkylphenoxypolyethoxyalkanols of U.S. Pat. No. 2,903,486 issued Sep. 8, 1959 to Brown et al. and represented by the formula

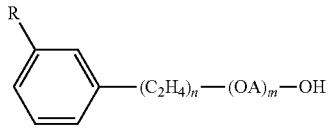

in which R is an alkyl group of 8 to 9 carbon atoms, A is an alkylene chain of 3 to 4 carbon atoms, n is an integer of 7 to 16, and m is an integer of 1 to 10.

The polyalkylene glycol condensates of U.S. Pat. No. 3,048,548 issued Aug. 7, 1962 to Martin et al. having alternating hydrophilic oxyethylene chains and hydrophobic oxypropylene chains where the weight of the terminal hydrophobic chains, the weight of the middle hydrophobic unit and the weight of the linking hydrophilic units each represent about one-third of the condensate.

The defoaming nonionic surfactants disclosed in U.S. Pat. No. 3,382,178 issued May 7, 1968 to Lissant et al. having the general formula $Z[(OR)_nOH]_z$ wherein Z is alkoxylatable material, R is a radical derived from an alkaline oxide which can be ethylene and propylene and n is an integer from, for example, 10 to 2,000 or more and z is an integer determined by the number of reactive oxyalkylatable groups.

The conjugated polyoxyalkylene compounds described in U.S. Pat. No. 2,677,700, issued May 4, 1954 to Jackson et al. corresponding to the formula $Y(C_3H_6O)_n(C_2H_4O)_mH$ wherein Y is the residue of organic compound having from about 1 to 6 carbon atoms and one reactive hydrogen atom, n has an average value of at least about 6.4, as determined by hydroxyl number and m has a value such that the oxyethylene portion constitutes about 10% to about 90% by weight of the molecule.

The conjugated polyoxyalkylene compounds described in U.S. Pat. No. 2,674,619, issued Apr. 6, 1954 to Lundsted et al. having the formula $Y[(C_3H_6O_n(C_2H_4O)_mH]_x$ wherein Y is the residue of an organic compound having from about 2 to 6 carbon atoms and containing x reactive hydrogen atoms in which x has a value of at least about 2, n has a value such that the molecular weight of the polyoxypropylene hydrophobic base is at least about 900 and m has value such that the oxyethylene content of the molecule is from about 10% to about 90% by weight. Compounds falling within the scope of the definition for Y include, for example, propylene glycol, glycerine, pentaerythritol, trimethylolpropane, ethylenediamine and the like. The oxypropylene chains optionally, but advantageously, contain small amounts of ethylene oxide and the oxyethylene chains also optionally, but advantageously, contain small amounts of propylene oxide.

Additional conjugated polyoxyalkylene surface-active agents which are advantageously used in the compositions of this invention correspond to the formula: $P[(C_3H_6O)_n(C_2H_4O)_mH]_x$ wherein P is the residue of an organic compound having from about 8 to 18 carbon atoms and containing x reactive hydrogen atoms in which x has a value of 1 or 2, n has a value such that the molecular weight of the polyoxyethylene portion is at least about 44 and m has a value such that the oxypropylene content of the molecule is from about 10% to about 90% by weight. In either case the oxypropylene chains may contain optionally, but advantageously, small amounts of ethylene oxide and the oxyethylene chains may contain also optionally, but advantageously, small amounts of propylene oxide.

8. Polyhydroxy fatty acid amide surfactants suitable for use in the present compositions include those having the structural formula $R_2CON_{R1}Z$ in which: R1 is H, $C_1$-$C_4$ hydrocarbyl, 2-hydroxy ethyl, 2-hydroxy propyl, ethoxy, propoxy group, or a mixture thereof; $R_2$ is a $C_5$-$C_{31}$ hydrocarbyl, which can be straight-chain; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z can be derived from a reducing sugar in a reductive amination reaction; such as a glycityl moiety.

9. The alkyl ethoxylate condensation products of aliphatic alcohols with from about 0 to about 25 moles of ethylene oxide are suitable for use in the present compositions. The alkyl chain of the aliphatic alcohol can either be straight or branched, primary or secondary, and generally contains from 6 to 22 carbon atoms.

10. The ethoxylated $C_6$-$C_{18}$ fatty alcohols and $C_6$-$C_{18}$ mixed ethoxylated and propoxylated fatty alcohols are suitable surfactants for use in the present compositions, particularly those that are water soluble. Suitable ethoxylated fatty alcohols include the $C_6$-$C_{18}$ ethoxylated fatty alcohols with a degree of ethoxylation of from 3 to 50.

11. Suitable nonionic alkylpolysaccharide surfactants, particularly for use in the present compositions include those disclosed in U.S. Pat. No. 4,565,647, Llenado, issued Jan. 21, 1986. These surfactants include a hydrophobic group containing from about 6 to about 30 carbon atoms and a polysaccharide, e.g., a polyglycoside, hydrophilic group containing from about 1.3 to about 10 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

12. Fatty acid amide surfactants suitable for use the present compositions include those having the formula: $R_6CON(R_7)_2$ in which $R_6$ is an alkyl group containing from 7 to 21 carbon atoms and each $R_7$ is independently hydrogen, $C_1$-$C_4$ alkyl, $C_1$-$C_4$ hydroxyalkyl, or $—(C_2H_4O)_xH$, where x is in the range of from 1 to 3.

13. A useful class of non-ionic surfactants include the class defined as alkoxylated amines or, most particularly, alcohol alkoxylated/aminated/alkoxylated surfactants. These non-ionic surfactants may be at least in part represented by the general formulae: $R^{20}—(PO)_sN\text{-}(EO)_tH$, $R^{20}—(PO)_sN\text{-}(EO)_tH(EO)_tH$, and $R^{20}—N(EO)_tH$; in which $R^{20}$ is an alkyl, alkenyl or other aliphatic group, or an alkyl-aryl group of from 8 to 20, preferably 12 to 14 carbon atoms, EO is oxyethylene, PO is oxypropylene, s is 1 to 20, preferably 2-5, t is 1-10, preferably 2-5, and u is 1-10, preferably 2-5. Other variations on the scope of these compounds may be represented by the alternative formula: $R^{20}—(PO)_v—N[(EO)_wH][(EO)_zH]$ in which $R^{20}$ is as defined above, v is 1 to 20 (e.g., 1, 2, 3, or 4 (preferably 2)), and w and z are independently 1-10, preferably 2-5. These compounds are represented commercially by a line of products sold by Huntsman Chemicals as nonionic surfactants. A preferred chemical of this class includes Surfonic™ PEA 25 Amine Alkoxylate. Preferred nonionic surfactants for the compositions of the invention include alcohol alkoxylates, EO/PO block copolymers, alkylphenol alkoxylates, and the like.

The treatise *Nonionic Surfactants*, edited by Schick, M. J., Vol. 1 of the Surfactant Science Series, Marcel Dekker, Inc., New York, 1983 is an excellent reference on the wide variety of nonionic compounds generally employed in the practice of the present invention. A typical listing of nonionic classes, and species of these surfactants, is given in U.S. Pat. No. 3,929,678 issued to Laughlin and Heuring on Dec. 30, 1975. Further examples are given in "Surface Active Agents and detergents" (Vol. I and II by Schwartz, Perry and Berch).

Additional Functional Ingredients

The components of the sanitizing and rinsing compositions can further be combined with various functional components suitable for use in ware wash and other sanitizing applications. In some embodiments, the compositions including the peroxycarboxylic acid, carboxylic acid, hydrogen peroxide, solvent and/or water, and/or rinse aid surfactants make up a large amount, or even substantially all of the total weight of the sanitizing and rinsing composition. For example, in some embodiments few or no additional functional ingredients are disposed therein.

In other embodiments, additional functional ingredients may be included in the compositions. The functional ingredients provide desired properties and functionalities to the compositions. For the purpose of this application, the term "functional ingredient" includes a material that when dispersed or dissolved in a use and/or concentrate solution, such as an aqueous solution, provides a beneficial property in a particular use. Some particular examples of functional materials are discussed in more detail below, although the particular materials discussed are given by way of example only, and that a broad variety of other functional ingredients may be used. For example, many of the functional materials discussed below relate to materials used in cleaning, specifically ware wash applications. However, other embodiments may include functional ingredients for use in other applications.

In other embodiments, the compositions may include defoaming agents, anionic surfactants, fluorescent tracers (including those disclosed for example in U.S. patent application Ser. No. 13/785,405, which is incorporated herein by reference), anti-redeposition agents, bleaching agents, solubility modifiers, dispersants, additional rinse aids, antiredeposition agents, metal protecting agents and/or etch protection convention for use in ware washing applications, stabilizing agents, corrosion inhibitors, additional sequestrants and/or chelating agents, humectants, pH modifiers, fragrances and/or dyes, rheology modifiers or thickeners, hydrotropes or couplers, buffers, solvents and the like, such as those disclosed in U.S. Publication No. 2012/0225805, which is herein incorporated by reference in its entirety.

Hydrotropes or Couplers

In some embodiments, the compositions of the present invention can include a hydrotrope or coupler. These may be used to aid in maintaining the solubility of the wetting and/or defoaming surfactants as well as a coupling agent for the peroxycarboxylic acid components. In some embodiments, hydrotropes are low molecular weight n-octane sulfonate and aromatic sulfonate materials such as alkyl benzene sulfonate, xylene sulfonates, naphthalene sulfonate, dialkyldiphenyl oxide sulfonate materials, and cumene sulfonates.

A hydrotrope or combination of hydrotropes can be present in the compositions at an amount of from between about 1 wt-% to about 50 wt-%. In other embodiments, a hydrotrope or combination of hydrotropes can be present at about 10 wt-% to about 40 wt-% of the composition. Without limiting the scope of invention, the numeric ranges are inclusive of the numbers defining the range and include each integer within the defined range.

Peracid Stabilizing Agent

A peracid stabilizing agent or agents may be included in compositions according to the invention. Beneficially, the peracid stabilizing agent(s) prevents the decomposition of peracid in an equilibrium peracid composition. In addition, peracid stabilizing agent(s) may prevent an equilibrium peracid composition from exceeding reaching their self-accelerating decomposition temperatures (SADT).

Suitable stabilizing agents include, for example, chelating agents or sequestrants. Suitable sequestrants include, but are not limited to, organic chelating compounds that sequester metal ions in solution, particularly transition metal ions. Such sequestrants include organic amino- or hydroxy-polyphosphonic acid complexing agents (either in acid or soluble salt forms), carboxylic acids (e.g., polymeric polycarboxylate), hydroxycarboxylic acids, aminocarboxylic acids, or heterocyclic carboxylic acids, e.g., pyridine-2,6-dicarboxylic acid (dipicolinic acid).

In some embodiments, the compositions of the present invention include dipicolinic acid as a stabilizing agent. Compositions including dipicolinic acid can be formulated to be free or substantially free of phosphorous. In an aspect of the invention, the stabilizing agent is a pyridine carboxylic acid compound. Pyridine carboxylic acids include dipicolinic acids, including for example, 2,6-pyridinedicarboxylic acid (DPA). In a further aspect, the stabilizing agent is a picolinic acid, or a salt thereof. In an aspect of the invention, the stabilizing agent is a picolinic acid or a compound having the following Formula (IA):

(IA)

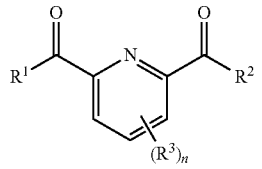

wherein $R^1$ is OH or —$NR^{1a}R^{1b}$, wherein $R^{1a}$ and $R^{1b}$ are independently hydrogen or $(C_1\text{-}C_6)$alkyl; $R^2$ is OH or —$NR^{2a}R^{2b}$, wherein $R^{2a}$ and $R^{2b}$ are independently hydrogen or $(C_1\text{-}C_6)$alkyl; each $R^3$ is independently $(C_1\text{-}C_6)$alkyl, $(C_2\text{-}C_6)$alkenyl or $(C_2\text{-}C_6)$alkynyl; and n is a number from zero to 3; or a salt thereof.

In a further aspect of the invention, the peracid stabilizing agent is a compound having the following Formula (IB):

(IB)

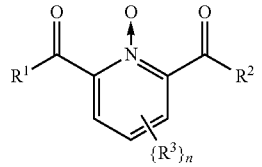

wherein $R^1$ is OH or —$NR^{1a}R^{1b}$, wherein $R^{1a}$ and $R^{1b}$ are independently hydrogen or $(C_1\text{-}C_6)$alkyl; $R^2$ is OH or —$NR^{2a}R^{2b}$, wherein $R^{2a}$ and $R^{2b}$ are independently hydrogen or $(C_1\text{-}C_6)$alkyl; each $R^3$ is independently $(C_1\text{-}C_6)$alkyl, $(C_2\text{-}C_6)$alkenyl or $(C_2\text{-}C_6)$alkynyl; and n is a number from zero to 3; or a salt thereof. Dipicolinic acid has been used as a stabilizer for peracid compositions, such as disclosed in WO 91/07375 and U.S. Pat. No. 2,609,391, which are herein incorporated by reference in their entirety.

In a further aspect, the stabilizing agent is a phosphate stabilizer or a phosphonate based stabilizer, such as Dequest 2010. Phosphate based stabilizers are known to act as metal chelators or sequestrants. Conventional phosphate based stabilizing agents include for example, 1-hydroxy ethylidene-1,1-diphosphonic acid ($CH_3C(PO_3H_2)_2OH$) (HEDP). In other embodiments, the sequestrant can be or include phosphonic acid or phosphonate salt. Suitable phosphonic acids and phosphonate salts include HEDP; ethylenediamine tetrakis methylenephosphonic acid (EDTMP); diethylenetriamine pentakis methylenephosphonic acid (DTPMP); cyclohexane-1,2-tetramethylene phosphonic acid; amino[tri(methylene phosphonic acid)]; (ethylene diamine[tetra methylene-phosphonic acid)]; 2-phosphene butane-1,2,4-tricarboxylic acid; or salts thereof, such as the alkali metal salts, ammonium salts, or alkyloyl amine salts, such as mono, di, or tetra-ethanolamine salts; picolinic, dipicolinic acid or mixtures thereof. In some embodiments, organic phosphonates, e.g., HEDP are included in the compositions of the present invention.

Commercially available food additive chelating agents include phosphonates sold under the trade name DEQUEST® including, for example, 1-hydroxyethylidene-1,1-diphosphonic acid, available from Monsanto Industrial Chemicals Co., St. Louis, Mo., as DEQUEST® 2010; amino(tri(methylenephosphonic acid)), ($N[CH_2PO_3H_2]_3$), available from Monsanto as DEQUEST® 2000; ethylenediamine[tetra(methylenephosphonic acid)]available from Monsanto as DEQUEST® 2041; and 2-phosphonobutane-1,2,4-tricarboxylic acid available from Mobay Chemical Corporation, Inorganic Chemicals Division, Pittsburgh, Pa., as Bayhibit® AM.

According to various embodiments of the invention, the stabilizing agent can be or include aminocarboxylic acid type sequestrants. Suitable aminocarboxylic acid type sequestrants include the acids or alkali metal salts thereof, e.g., amino acetates and salts thereof. Suitable aminocarboxylates include N-hydroxyethylaminodiacetic acid; hydroxyethylenediaminetetraacetic acid, nitrilotriacetic acid (NTA); ethylenediaminetetraacetic acid (EDTA); N-hydroxyethyl-ethylenediaminetriacetic acid (HEDTA); diethylenetriaminepentaacetic acid (DTPA); and alanine-N,N-diacetic acid; and the like; and mixtures thereof.

According to still further embodiments of the invention, the stabilizing agent can be or include a polycarboxylate. Suitable polycarboxylates include, for example, polyacrylic acid, maleic/olefin copolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, hydrolyzed acrylonitrile-methacrylonitrile copolymers, polymaleic acid, polyfumaric acid, copolymers of acrylic and itaconic acid, phosphino polycarboxylate, acid or salt forms thereof, mixtures thereof, and the like.

In other embodiments the stabilizing agent may be a low-phosphate or a phosphate-free stabilizer to provide either low-phosphate or phosphate-free sanitizing and rinsing compositions.

In a still further aspect, a combination of more than one stabilizing agent may be employed. Stabilizing agent(s) may be present in amounts sufficient to provide the intended stabilizing benefits, namely achieving the desired shelf life and/or elevating the SADT of a concentrated peroxycarboxylic acid composition. Peracid stabilizing agents may be present in a concentrated equilibrium peracid composition in amounts from about 0.001 wt-% to about 25 wt-%, 0.01 wt-% to about 10 wt-%, and more preferably from about 0.1 wt-% to about 10 wt-%. Without limiting the scope of invention, the numeric ranges are inclusive of the numbers defining the range and include each integer within the defined range.

Defoaming Agent

The present invention may include a defoaming agent. Defoaming agents suitable for use in the peroxycarboxylic acid compositions according to the invention are compatible with peracid compositions and the nonionic surfactants in the single, dual functioning sanitizing and rinsing formulations. The defoaming agents suitable for use in the peroxycarboxylic acid compositions according to the invention, maintain a low foam profile under various water conditions, preferably under deionized or soft water conditions, and/or under mechanical action. In a still further aspect, the defoaming agents are compatible with surfactants, preferably anionic surfactants, to achieve critical performance such as coupling/wetting, improved material compatibility and enhanced biocidal efficacy.

In preferred aspects, the defoaming agent provides a synergistic biocidal efficacy. In an aspect of the invention, the defoaming agent is a metal salt, including for example, aluminum, magnesium, calcium, zinc and/or other rare earth metal salts. In a preferred aspect, the defoaming agent is a cation with high charge density, such as $Fe^{3+}$, $Al^{3+}$ and $La^{3+}$. In a preferred aspect, the defoaming agent is aluminum sulfate. In other aspects, the defoaming agent is not a transition metal compound. In some embodiments, the compositions of the present invention can include antifoaming agents or defoamers which are of food grade quality, including for example silicone-based products, given the application of the method of the invention.

In an aspect of the invention, the defoaming agent can be used at any suitable concentration to provide defoaming with the surfactants according to the invention. In some embodiments, a concentrated equilibrium composition has a concentration of the a defoaming agent from about 0.001 wt-% to about 10 wt-%, or from about 0.1 wt-% to about 5 wt-%. In still other embodiments, the defoaming agent has a concentration from about 0.1 wt-% to about 1 wt-%. Without limiting the scope of invention, the numeric ranges are inclusive of the numbers defining the range and include each integer within the defined range.

Anti-Redeposition Agents

The sanitizing rinse aid compositions can optionally include an anti-redeposition agent capable of facilitating sustained suspension of soils in a rinse solution and preventing removed soils from being redeposited onto the substrate being rinsed. Some examples of suitable anti-redeposition agents can include fatty acid amides, fluorocarbon surfactants, complex phosphate esters, styrene maleic anhydride copolymers, and cellulosic derivatives such as hydroxyethyl cellulose, hydroxypropyl cellulose, and the like. A rinse aid composition may include up to about 10 wt-% of an anti-redeposition agent.

Methods of Use

The compositions of the invention, including PSO-containing alkaline detergent compositions and the sanitizing rinse aid compositions, are suitable for use in various applications and methods, including ware wash applications. In an aspect, the present invention includes use of the compositions for cleaning and then sanitizing and rinsing surfaces and/or products.

Ware Washing

The methods of use are particularly suitable for ware washing. Suitable methods for using the detergent compositions and sanitizing rinse aid compositions for ware washing are set forth in U.S. Pat. No. 5,578,134, which is herein incorporated by reference in its entirety. Beneficially, according to certain embodiments of the invention, the methods provide the following unexpected benefits: reduction or prevention in soil redeposition on the treated surfaces; reduction or prevention of hardness accumulation on the treated surfaces; and suitable for use with a single, dual-functioning composition containing a detergent(s), rinse additive(s) and an optional additional functional component for sanitizing and/or rinsing. In still further embodiments of the invention, the methods for ware washing may additionally provide any one or more of the following unexpected benefits for ware washing applications: improved ware washing results (including sanitizing efficacy and/or rinsing); elimination of any need for rewashing of wares; chlorine-free formulations; and/or low phosphorous formulations or substantially phosphorous-free formulations.

Exemplary articles in the ware washing industry that can be treated with a sanitizing rinse aid composition according to the invention include plastics, dishware, cups, glasses, flatware, and cookware. For the purposes of this invention, the terms "dish" and "ware" are used in the broadest sense to refer to various types of articles used in the preparation, serving, consumption, and disposal of food stuffs including pots, pans, trays, pitchers, bowls, plates, saucers, cups, glasses, forks, knives, spoons, spatulas, and other glass, metal, ceramic, plastic composite articles commonly available in the institutional or household kitchen or dining room. In general, these types of articles can be referred to as food or beverage contacting articles because they have surfaces which are provided for contacting food and/or beverage.

Methods of use employing the detergent compositions and sanitizing rinse aid compositions according to the invention are particularly suitable for institutional ware washing. Exemplary disclosure of ware washing applications is set forth in U.S. Patent Publication Nos. 2013/0146102, 2012/0291815 and 2012/0291808, including all references cited therein, which are herein incorporated by reference in its entirety. The method may be carried out in any consumer or institutional dish machine, including for example those described in U.S. Pat. No. 8,092,613, which is incorporated herein by reference in its entirety, including all figures and drawings. Some non-limiting examples of dish machines include door machines or hood machines, conveyor machines, undercounter machines, glasswashers, flight machines, pot and pan machines, utensil washers, and consumer dish machines. The dish machines may be either single tank or multi-tank machines.

A door dish machine, also called a hood dish machine, refers to a commercial dish machine wherein the soiled dishes are placed on a rack and the rack is then moved into the dish machine. Door dish machines clean one or two racks at a time. In such machines, the rack is stationary and the wash and rinse arms move. A door machine includes two sets arms, a set of wash arms and a rinse arm, or a set of rinse arms.

Door machines may be a high temperature or low temperature machine. In a high temperature machine the dishes are sanitized by hot water. In a low temperature machine the dishes are sanitized by the chemical sanitizer. The door machine may either be a recirculation machine or a dump and fill machine. In a recirculation machine, the detergent solution is reused, or "recirculated" between wash cycles. The concentration of the detergent solution is adjusted between wash cycles so that an adequate concentration is maintained. In a dump and fill machine, the wash solution is not reused between wash cycles. New detergent solution is added before the next wash cycle. Some non-limiting examples of door machines include the Ecolab Omega HT, the Hobart AM-14, the Ecolab ES-2000, the Hobart LT-1, the CMA EVA-200, American Dish Service L-3DW and HT-25, the Autochlor A5, the Champion D-HB, and the Jackson Tempstar.

In an aspect of the invention, the methods include a first step of cleaning a surface with a detergent composition according to the invention, and thereafter sanitizing and rinsing the surface with a sanitizing and rinse aid composition according to the invention.

In an aspect, the detergent composition comprises an alkalinity source selected from the group consisting of alkali metal carbonate, alkali metal hydroxide, alkali metal silicate, alkali metal metasilicate and combinations thereof, phosphinosuccinic acid adducts comprising the following formulas:

(I)

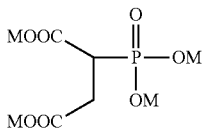

-continued (II)

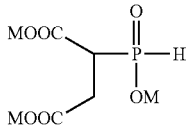

(III)

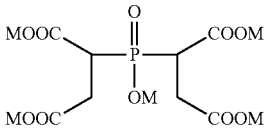

(IV)

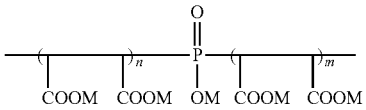

wherein M is selected from the group consisting of H+, Na+, K+, NH4+, and mixtures thereof, wherein m and n are 0 or an integer, and wherein m plus n is greater than 2.

In an aspect, the sanitizing and rinse aid composition comprises a C1-C22 peroxycarboxylic acid, a C1-C22 carboxylic acid, hydrogen peroxide, and a nonionic defoaming and wetting surfactant(s). In a further aspect, the sanitizing and rinse aid composition is a low odor concentrate having less than about 2 wt-% peroxyacetic and peracid acid. In a further aspect, the sanitizing and rinse aid composition when diluted from about 0.01% weight/volume to about 2% weight/volume provides at least a 5 log reduction in pathogenic organisms at a temperature of at least about 100° F.

Cleaning

In an aspect, the step of cleaning a surface with the detergent compositions according to the invention provide effective reduction and/or prevention of hard water scale accumulation and/or soil redeposition in ware washing applications using a variety of water sources, including hard water. In addition, the detergent compositions are suitable for use at temperature ranges typically used in commercial and/or industrial ware washing applications, including for example at temperatures above about 100° F. In other aspects, the temperature ranges may be from about 100° F. to about 165° F., from about 150° F. to about 165° F. during washing steps and from about 170° F. to about 185° F. during rinsing steps.

The detergent composition, which may be formed prior to or at the point of use by combining the PSO derivatives, alkalinity source and other desired components (e.g. optional polymers and/or surfactants) in the weight percentages disclosed herein. The detergent compositions can be a single or multiple component product. In an aspect, the methods may further include the forming of the detergent compositions at the point of use. For example, the alkali metal hydroxide and PSO adducts may be added separately to a ware wash application. The PSO component may be added in acidic or neutralized form and combined with the alkali metal hydroxide to form a use solution between pH of about 9-12.5. Both the alkali metal hydroxide and PSO adduct solutions may comprise additional components such as for example, nonionic surfactants, anionic surfactants, polymers, oxidizers and corrosion inhibitors.

The cleaning step involves applying a cleaning solution of the compositions of the invention onto a hard surface and allowing residence time on the surface for the detergency effect. The methods may further include the step of applying rinse water and/or other rinse aid to remove the alkaline detergent composition. The methods of the invention beneficially reduce the formation, precipitation and/or deposition of hard water scale, such as calcium carbonate, on hard surfaces contacted by the detergent compositions. In an embodiment, the detergent compositions are employed for the prevention of formation, precipitation and/or deposition of hard water scale.

The detergent composition may be provided in various formulations, including for example solids, liquids, powders, pastes, gels, etc. The methods may also employ a concentrate and/or a use solution constituting an aqueous solution or dispersion of a concentrate. Such use solutions may be formed during the washing process.

Solid detergent compositions provide certain commercial advantages for use according to the invention. For example, use of concentrated solid detergent compositions decrease shipment costs as a result of the compact solid form, in comparison to bulkier liquid products. In certain embodiments of the invention, solid products may be provided in the form of a multiple-use solid, such as, a block or a plurality of pellets, and can be repeatedly used to generate aqueous use solutions of the detergent composition for multiple cycles or a predetermined number of dispensing cycles. In certain embodiments, the solid detergent compositions may have a mass greater than about 5 grams, such as for example from about 5 grams to 10 kilograms. In certain embodiments, a multiple-use form of the solid detergent composition has a mass of about 1 kilogram to about 10 kilogram or greater.

In aspects of the invention employing packaged solid detergent compositions, the products may first require removal from any applicable packaging (e.g. film). Thereafter, according to certain methods of use, the compositions can be inserted directly into a dispensing apparatus and/or provided to a water source for cleaning according to the invention. Examples of such dispensing systems include for example U.S. Pat. Nos. 4,826,661, 4,690,305, 4,687,121, 4,426,362 and U.S. Pat. Nos. Re 32,763 and 32,818, the disclosures of which are incorporated by reference herein in its entirety. Ideally, a solid detergent composition is configured or produced to closely fit the particular shape(s) of a dispensing system in order to prevent the introduction and dispensing of an incorrect solid product into the apparatus of the present invention.

In certain embodiments, the detergent compositions may be mixed with a water source prior to or at the point of use for the cleaning step. A use solution may be prepared from a concentrate by diluting the concentrate with water at a dilution ratio that provides a use solution having desired cleaning properties. The water that is used to dilute the concentrate to form the use composition can be referred to as water of dilution or a diluent, and can vary from one location to another. The typical dilution factor is between approximately 1 and approximately 10,000 but will depend on factors including water hardness, the amount of soil to be removed and the like. In an embodiment, the concentrate is diluted at a ratio of between about 1:10 and about 1:10,000 concentrate to water. Particularly, the concentrate is diluted at a ratio of between about 1:100 and about 1:5,000 concentrate to water. More particularly, the concentrate is diluted at a ratio of between about 1:250 and about 1:2,000 concentrate to water. In other embodiments, the detergent compositions do not require the formation of a use solution and/or further dilution and may be used without further dilution.

In some aspects, a use solution of the detergent composition may comprise, consist and/or consist essentially of about from about 100-20,000 ppm of an alkalinity source, from about 1-2,000 ppm phosphinosuccinic acid adducts, and from about 1-1,000 ppm of a polymer having a use pH of between about 9 and about 12.5.

In aspects of the invention employing solid detergent compositions, a water source contacts the detergent composition to convert solid detergent compositions, particularly powders, into use solutions. Additional dispensing systems may also be utilized which are more suited for converting alternative solid detergents compositions into use solutions. The methods of the present invention include use of a variety of solid detergent compositions, including, for example, extruded blocks or "capsule" types of package. In an aspect, a dispenser may be employed to spray water (e.g. in a spray pattern from a nozzle) to form a detergent use solution. For example, water may be sprayed toward an apparatus or other holding reservoir with the detergent composition, wherein the water reacts with the solid detergent composition to form the use solution. In certain embodiments of the methods of the invention, a use solution may be configured to drip downwardly due to gravity until the dissolved solution of the detergent composition is dispensed for use according to the invention. In an aspect, the use solution may be dispensed into a wash solution of a ware wash machine.

In optional aspects, the step of cleaning a surface to remove a soil (including organic, inorganic or a mixture of the two components) can further include the steps of applying an acid solution wash and/or a fresh water rinse, in addition to the cleaning step where the alkaline detergent composition contacts the surface. In such an embodiment, without being limited to a particular mechanism of action, the alkaline solution softens the soils and removes the organic alkaline soluble soils. The optional use of subsequent acid solution may be beneficial to remove mineral soils left behind by the alkaline cleaning step. The strength of the alkaline and acid solutions and the duration of the cleaning steps are typically dependent on the durability of the soil.

Sanitizing and Rinsing

In an aspect, the step of sanitizing and rinsing a surface with the sanitizing and rinsing compositions according to the invention can include the use of any suitable level of the peroxycarboxylic acid. In some embodiments, the treated target composition comprises from about 1 ppm to about 1000 ppm of the peroxycarboxylic acid when diluted for use, including any of the peroxycarboxylic acid compositions according to the invention. The various applications of use described herein provide the peroxycarboxylic acid compositions to a surface and/or product in need of sanitizing and rinsing. Beneficially, the compositions of the invention are fast-acting. However, the present methods require a certain minimal contact time of the compositions with the surface, liquid and/or product in need of treatment for occurrence of sufficient antimicrobial effect. The contact time can vary with concentration of the use compositions, method of applying the use compositions, temperature of the use compositions, pH of the use compositions, amount of the surface, liquid and/or product to be treated, amount of soil or substrates on/in the surface, liquid and/or product to be treated, or the like. The contact or exposure time can be about 15 seconds, at least about 15 seconds, about 30 seconds or greater than 30 seconds. In some embodiments, the exposure time is about 1 to 5 minutes. In other embodiments, the exposure time is at least about 10 minutes, 30 minutes, or 60 minutes. In other embodiments, the exposure time is a few minutes to hours. In other embodiments, the exposure time is a few hours to days. The contact time will further vary based upon the concentration of peracid in a use solution.

The present methods for the sanitizing and rinsing step can be conducted at any suitable temperature. In some embodiments, the present methods are conducted at a temperature ranging from about 0° C. to about 70° C., e.g., from about 0° C. to about 4° C. or 5° C., from about 5° C. to about 10° C., from about 11° C. to about 20° C., from about 21° C. to about 30° C., from about 31° C. to about 40° C., including at about 37° C., from about 41° C. to about 50° C., from about 51° C. to about 60° C., or from about 61° C. to about 82° C., or at increased temperatures there above suitable for a particular application of use.

The sanitizing and rinsing compositions may include concentrate compositions or may be diluted to form use compositions. In general, a concentrate refers to a composition that is intended to be diluted with water to provide a use solution that contacts a surface and/or product in need of treatment to provide the desired cleaning, sanitizing or the like. The peroxycarboxylic acid composition that contacts the surface and/or product in need of treatment can be referred to as a concentrate or a use composition (or use solution) dependent upon the formulation employed in methods according to the invention. It should be understood that the concentration of the peroxycarboxylic acid in the composition will vary depending on whether the composition is provided as a concentrate or as a use solution.

A use solution may be prepared from the concentrate by diluting the concentrate with water at a dilution ratio that provides a use solution having desired sanitizing and/or other antimicrobial properties. The water that is used to dilute the concentrate to form the use composition can be referred to as water of dilution or a diluent, and can vary from one location to another. The typical dilution factor is between approximately 1 and approximately 10,000 but will depend on factors including water hardness, the amount of soil to be removed and the like. In an embodiment, the concentrate is diluted at a ratio of between about 1:10 and about 1:10,000 concentrate to water. Particularly, the concentrate is diluted at a ratio of between about 1:100 and about 1:5,000 concentrate to water. More particularly, the concentrate is diluted at a ratio of between about 1:250 and about 1:2,000 concentrate to water.

In a preferred aspect, the highly concentrated peroxycarboxylic acid of the sanitizing rinse additive composition is diluted from about 0.001% (wt/vol.) to about 2% (wt/vol.), or from about 0.001% (wt/vol.) to about 1% (wt/vol.), or from about 0.01% (wt/vol.) to about 0.05% (wt/vol.), and preferably to approximately 0.025% (wt/vol.). Without being limited to a particular dilution of the concentrated sanitizing rinse additive composition, in some aspects this dilution corresponds to approximately 0.5 mL to about 3 mL of the liquid concentrate per dish machine cycle (as one skilled in the art understands to further dependent on the rinse water volume of the dish machine). Without limiting the scope of invention, the numeric ranges are inclusive of the numbers defining the range and include each integer within the defined range.

In further aspects use of the sanitizing and rinsing compositions according to the invention, provides effective sheeting action and low foaming properties. In additional aspects, the sanitizing and rinsing step can be biodegradable, environmentally friendly, and generally nontoxic (e.g. as often referred to as employing a "food grade" rinse aid).

According to the various applications of use, the sanitizing and rinse aid compositions are suitable for antimicrobial efficacy against a broad spectrum of microorganisms, providing broad spectrum bactericidal and fungistatic activity. For example, the peracid biocides of this invention provide broad spectrum activity against wide range of different types of microorganisms (including both aerobic and anaerobic microorganisms, gram positive and gram negative microorganisms), including bacteria, yeasts, molds, fungi, algae, and other problematic microorganisms.

The present methods can be used to achieve any suitable reduction of the microbial population in and/or on the target or the treated target composition. In some embodiments, the present methods can be used to reduce the microbial population in and/or on the target or the treated target composition by at least one $\log_{10}$. In other embodiments, the present methods can be used to reduce the microbial population in and/or on the target or the treated target composition by at least two $\log_{10}$. In still other embodiments, the present methods can be used to reduce the microbial population in and/or on the target or the treated target composition by at least three $\log_{10}$. In still other embodiments, the present methods can be used to reduce the microbial population in and/or on the target or the treated target composition by at least five $\log_{10}$. Without limiting the scope of invention, the numeric ranges are inclusive of the numbers defining the range and include each integer within the defined range.

Cleaning Additional Surfaces

The methods of use are also suitable for treating a variety of surfaces, products and/or target in addition to ware. The methods are suitable for any use to clean, sanitize and rinse a surface. For example, these may include a food item or a plant item and/or at least a portion of a medium, a container, an equipment, a system or a facility for growing, holding, processing, packaging, storing, transporting, preparing, cooking or serving the food item or the plant item. The present methods can be used for treating any suitable plant item. In some embodiments, the plant item is a grain, fruit, vegetable or flower plant item, a living plant item or a harvested plant item. In addition, the present methods can be used for treating any suitable food item, e.g., an animal product, an animal carcass or an egg, a fruit item, a vegetable item, or a grain item. In still other embodiments, the food item may include a fruit, grain and/or vegetable item.

In a still further embodiment, the methods of the invention are suitable for meeting various regulatory standards, including for example EPA food contact sanitizers requiring at least a 5 log reduction in pathogenic microorganisms in 30 seconds and/or NSF standards similarly requiring at least a 5 log reduction in treated pathogenic microorganisms. In still further aspects, without limiting the scope of the invention, the methods of the invention may provide sufficient sanitizing efficacy at conditions more or less strenuous than such regulatory standards.

The present methods can be used for treating a target that is at least a portion of a container, an equipment, a system or a facility for holding, processing, packaging, storing, transporting, preparing, cooking or serving the food item or the plant item. In some embodiments, the target is at least a portion of a container, an equipment, a system or a facility for holding, processing, packaging, storing, transporting, preparing, cooking or serving a meat item, a fruit item, a vegetable item, or a grain item. In other embodiments, the target is at least a portion of a container, an equipment, a system or a facility for holding, processing, packaging, storing, or transporting an animal carcass. In still other embodiments, the target is at least a portion of a container, an equipment, a system or a facility used in food processing, food service or health care industry. In yet other embodiments, the target is at least a portion of a fixed in-place process facility. An exemplary fixed in-place process facility can comprise a milk line dairy, a continuous brewing system, a pumpable food system or a beverage processing line.

The present methods can be used for treating a target that is at least a portion of a solid surface. In some embodiments, the solid surface is an inanimate solid surface. The inanimate solid surface can be contaminated by a biological fluid, e.g., a biological fluid comprising blood, other hazardous body fluid, or a mixture thereof. In other embodiments, the solid surface can be a contaminated surface. An exemplary contaminated surface can comprise the surface of food service wares or equipment.

Still further examples of applications of use for the methods according to the invention for cleaning, sanitizing and rinsing compositions include, for example, grill and oven cleaners, ware wash detergents, laundry detergents, laundry presoaks, drain cleaners, hard surface cleaners, surgical instrument cleaners, transportation vehicle cleaning, vehicle cleaners, dish wash presoaks, dish wash detergents, beverage machine cleaners, concrete cleaners, building exterior cleaners, metal cleaners, floor finish strippers, degreasers and burned-on soil removers.

All publications and patent applications in this specification are indicative of the level of ordinary skill in the art to which this invention pertains. All publications and patent applications are herein incorporated by reference to the same extent as if each individual publication or patent application was specifically and individually indicated as incorporated by reference.

EXAMPLES

Embodiments of the present invention are further defined in the following non-limiting examples. It should be understood that these examples, while indicating certain embodiments of the invention, are given by way of illustration only. From the above discussion and the examples, one skilled in the art can ascertain the essential characteristics of this invention, and without departing from the spirit and scope thereof, can make various changes and modifications of the embodiments of the invention to adapt it to various usages and conditions. Thus, various modifications of the embodiments of the invention, in addition to those shown and described herein, will be apparent to those skilled in the art from the foregoing description. Such modifications are also intended to fall within the scope of the appended claims.

Example 1

Ware wash cleaning methods for glassware was evaluated to determine impact of ware washing methods and compositions according to the invention on glass filming, spotting, and soil removal in an institutional dishmachine. The cleaning efficacy of the detergent compositions and sanitizing and rinse compositions according to the invention was evaluated using a 7 cycle soil removal experiment. The evaluated compositions are shown in Tables 3A and 3B and were evaluated against commercially-available Controls as follows:

Detergent control (commercially-available alkaline detergent containing 5-20 wt-% sodium metasilicate).

Sanitizer control (commercially-available sanitizer containing 5-10 wt-% sodium hypochlorite).

Rinse Aid control (commercially-available rinse aid solid containing 5-20 wt-% urea and 1-5 wt-% stearamide monoethanolamine).

TABLE 3A (Detergent composition)

| Raw material | EXP 1A |
|---|---|
| Water | 10-40 |
| Sodium hydroxide (50% liquid) | 60-85 |
| PSO (32.5% active) | 5-15 |
| Total | 100 |
| Dosing | 650 ppm |

TABLE 3B (Sanitizer/rinse aid composition)

| Raw material | EXP 1B |
|---|---|
| Hydrogen peroxide (50%) | 20-50 |
| SXS (40%) | 30-45 |
| Nonionic Surfactant (alcohol alkoxylate) | 5-15 |
| Nonionic Surfactant (alcohol ethoxylate) | 1-5 |
| Dipicolinic acid | 0.001-0.1 |
| HEDP (60%) | 1-5 |
| Octanoic acid | 5-15 |
| Total | 100 |

To test the ability of the various detergent, sanitizing and/or rinsing compositions to clean glass and plastic, twelve 10 oz. Libby heat resistant glass tumblers and four plastic tumblers were used. The glass tumblers were cleaned prior to use. New plastic tumblers were used for each experiment.

A food soil solution used at 2000 ppm was prepared using a 50/50 combination of beef stew and hot point soil. The soil included two cans of Dinty Moore Beef Stew (1360 grams), one large can of tomato sauce (822 grams), 15.5 sticks of Blue Bonnet Margarine (1746 grams) and powered milk (436.4 grams).

After filling the dishmachine with 17 grain water, the heaters were turned on. The final rinse temperature was adjusted to about 120° F. The glasses and plastic tumblers were soiled by rolling the glasses three times in a 1:1 (by volume) mixture of Campbell's Cream of Chicken Soup: Kemp's Whole Milk. The glasses were then placed in an oven at about 160° F. for about 8 minutes. While the glasses were drying, the dishmachine was primed with about 120 grams of the food soil solution, which corresponds to about 2000 ppm of food soil in the sump.

The soiled glass and plastic tumblers were placed in the Rabum rack (see figure below for arrangement; P=plastic tumbler; G=glass tumbler) and the rack was placed inside the dishmachine.

| | | | |
|---|---|---|---|
| | G6 | G6' | |
| | G5 | G5' | |
| P2 | G4 | G4' | P2' |
| P1 | G3 | G3' | P1' |
| | G2 | G2' | |
| | G1 | G1' | |

The dishmachine was then started and run through an automatic cycle. At the beginning of each cycle the detergent was dosed into the dishmachine; and during the rinse cycle the rinse and and/or sanitizer was dosed into the dishmachine. When the cycle ended, the top of the glass and plastic tumblers were mopped with a dry towel. The cycle was repeated for seven cycles. The glasses previously rolled in soup/milk were removed from the dishmachine and the soiling procedure was repeated, followed again by the seven cleaning cycles.

The glass and plastic tumblers were then graded by visual assessment in a glass viewing area against a black background. An average was determined for each set using the following rating scale (1 to 5). A rating of 1 indicated no film was present. A rating of 2 indicated that a trace amount of film was present (barely perceptible) under intense spot light conditions, however the film is not noticeable if the glass is help up to a florescent light source. A rating of 3 indicated that a slight film was present; the glass appeared slightly filmed when held up to a florescent light source. A rating of 4 indicated that a moderate amount of film was present; the glass appears hazy when held up to a florescent light source. A rating of 5 indicated that a heavy amount of filming present, wherein the glass appears cloudy when help up to a florescent light source.

The results are shown in Tables 4-6, for the following set of experiments.

Experiment 1 (Control 3-part system—detergent, sanitizer, and rinse aid): Inline Detergent/Sanitizer/Rinse Aid test employing 1100 ppm Detergent Control, 2.0 mL/cycle Sanitizing Control and 5.0 mL/cycle Rinse Aid Control.

Experiment 2 (Control 2-part system—detergent and sanitizer): Inline Detergent/Sanitizer Control Test employing 1100 ppm Detergent Control and 5.0 mL/cycle Sanitizing Control.

Experiment 3 (Exemplary Formulation 2-part system—detergent and sanitizer/rinse aid) employing 650 ppm EXP 1A, 2.5 mL/cycle EXP 1B.

TABLE 4

(Control 3-part system)
Inline- Detergent/Sanitizer/Rinse Aid Test, Experiment 1

| Glass | Film Score |
|---|---|
| G1 | 4.0 |
| G2 | 4.0 |
| G3 | 5.0 |
| G4 | 5.0 |
| G5 | 5.0 |
| G6 | 5.0 |
| P1 | 5.0 |
| P2 | 5.0 |
| Average Glass Score | 4.7 |
| Average Plastic Score | 5.0 |
| G1' | 5.0 |
| G2' | 5.0 |
| G3' | 5.0 |
| G4' | 5.0 |
| G5' | 5.0 |
| G6' | 5.0 |
| P1' | 5.0 |
| P2' | 5.0 |
| Average Glass Score | 5.0 |
| Average Plastic Score | 5.0 |

TABLE 5

(Control 2-part system)
Inline- Detergent/Sanitizer Test, Experiment 2

| Glass | Film Score |
|---|---|
| G1 | 5.0 |
| G2 | 5.0 |
| G3 | 5.0 |
| G4 | 5.0 |
| G5 | 5.0 |
| G6 | 5.0 |
| P1 | 5.0 |
| P2 | 5.0 |
| Average Glass Score | 5.0 |
| Average Plastic Score | 5.0 |
| G1' | 5.0 |
| G2' | 5.0 |
| G3' | 5.0 |
| G4' | 5.0 |
| G5' | 5.0 |
| G6' | 5.0 |
| P1' | 5.0 |
| P2' | 5.0 |
| Average Glass Score | 5.0 |
| Average Plastic Score | 5.0 |

TABLE 6

(Exemplary 2-part system)
EXP1A/1B System Test

| Glass | Film Score |
|---|---|
| G1 | 2.0 |
| G2 | 2.0 |
| G3 | 2.0 |
| G4 | 2.0 |
| G5 | 2.0 |
| G6 | 2.5 |
| P1 | 2.0 |
| P2 | 2.0 |
| Average Glass Score | 2.1 |
| Average Plastic Score | 2.0 |
| G1' | 2.0 |
| G2' | 2.0 |
| G3' | 2.0 |
| G4' | 2.0 |
| G5' | 2.0 |
| G6' | 2.0 |
| P1' | 2.0 |
| P2' | 2.0 |
| Average Glass Score | 2.0 |
| Average Plastic Score | 2.0 |

The results demonstrate the system comprising the detergent composition and sanitizing rinse aid (Experiment 3) provides improved cleaning of dishware in comparison to the control compositions (Experiments 1 and 2). The results further show that the detergent compositions according to the invention provide at least substantially similar cleaning efficacy and in various embodiments provide superior efficacy over commercial products.

The inventions being thus described, it will be obvious that the same may be varied in many ways. Such variations are not to be regarded as a departure from the spirit and scope of the inventions and all such modifications are intended to be included within the scope of the following claims.

What is claimed is:

1. A system for cleaning, sanitizing and rinsing a surface comprising:

(a) a detergent composition comprising: an alkalinity source selected from the group consisting of an alkali metal carbonate, alkali metal hydroxide, alkali metal silicate, alkali metal metasilicate, and combinations thereof; a phosphinosuccinic acid adduct comprising a phosphinosuccinic acid and mono-, bis- and oligomeric phosphinosuccinic acid adducts; and (b) a sanitizing rinse composition comprising: a C1-C22 peroxycarboxylic acid; a C1-C22 carboxylic acid; hydrogen peroxide; and at least one nonionic defoaming surfactant and at least one nonionic wetting surfactant.

2. The system of claim 1, wherein the phosphinosuccinic acid (I) and mono- (II), bis- (III) and oligomeric (IV) phosphinosuccinic acid adducts have the following formulas:

(I)

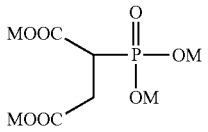

(II)

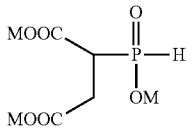

(III)

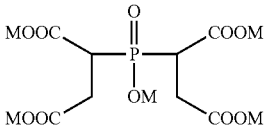

where M is selected from the group consisting of $H^+$, $Na^+$, $K^+$, $NH_4^+$, and mixtures thereof, wherein m and n are 0 or an integer, and wherein m plus n is greater than 2.

3. The system of claim 2, wherein the phosphinosuccinic acid adduct comprises at least 10 mol % of an adduct comprising a ratio of succinic acid to phosphorus from about 1:1 to 20:1.

4. The system of claim 3, wherein the phosphinosuccinic acid adduct of formula I constitutes between about 1-40 wt-% of the phosphinosuccinic acid adduct, the phosphinosuccinic acid adduct of formula II constitutes between about 1-25 wt-% of the phosphinosuccinic acid adduct, the phosphinosuccinic acid adduct of formula III constitutes between about 10-60 wt-% of the phosphinosuccinic acid adduct, the phosphinosuccinic acid adduct of formula IV constitutes between about 20-70 wt-% of the phosphinosuccinic acid adduct.

5. The system of claim 1, wherein a use solution of the detergent composition has a pH between about 9 and 12.5.

6. The system of claim 1, wherein the detergent composition further comprises an additional nonionic surfactant, an anionic surfactant, water, an oxidizer, and/or combinations thereof.

7. The system of claim 1, wherein the sanitizing rinse composition is a concentrate having less than about 2 wt-% peroxyacetic acid.

8. The system of claim 1, wherein the sanitizing rinse composition when diluted from about 0.01% weight/volume to about 2% weight/volume provides at least a 5-log reduction in pathogenic organisms at a temperature of at least about 100° F.

9. The system of claim 1, wherein the nonionic defoaming surfactant(s) and the nonionic wetting surfactant(s) of the sanitizing rinse composition comprises an alkyl-ethylene oxide-propylene oxide copolymer surfactant and an alcohol ethoxylate according to the following structure R—O—$(CH_2CH_2O)_n$—H, wherein R is a $C_1$-$C_{12}$ alkyl group and n is an integer in the range of 1 to 100.

10. A system for cleaning, sanitizing and rinsing a surface comprising:

(a) a concentrated detergent composition comprising: an alkalinity source selected from the group consisting of an alkali metal carbonate, alkali metal hydroxide, alkali metal silicate, alkali metal metasilicate, and combinations thereof; a phosphinosuccinic acid adduct comprising a phosphinosuccinic acid and mono-, bis- and oligomeric phosphinosuccinic acid adducts having the following formulas (I)

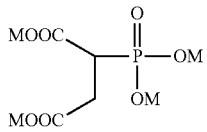

(II)

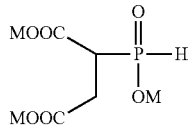

(III)

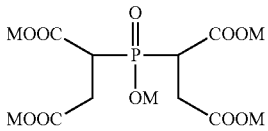

wherein M is selected from the group consisting of $H^+$, $Na^+$, $K^+$, $NH_4^+$, and mixtures thereof, wherein m and n are 0 or an integer, wherein m plus n is greater than 2, and wherein a use solution of the detergent composition has a pH between about 9 and 12.5; and (b) a sanitizing rinse composition comprising: a C1-C22 peroxycarboxylic acid; a C1-C22 carboxylic acid; hydrogen peroxide; and at least one nonionic defoaming surfactant and at least one nonionic wetting surfactant, wherein the sanitizing rinse composition is a concentrate having less than about 4 wt-% C1-C22 peroxycarboxylic acid, and wherein the sanitizing rinse composition when diluted from about 0.01% weight/volume to about 2% weight/volume provides at least a 5-log reduction in pathogenic organisms at a temperature of at least about 100° F.

11. The system of claim 10, wherein a use solution of the detergent composition comprises from about 100 ppm to about 20,000 ppm of the alkalinity source, and from about 1 ppm to about 2,000 ppm of the phosphinosuccinic acid adducts.

12. The system of claim 11, wherein the phosphinosuccinic acid adduct of formula I constitutes between about 1-40 wt-% of the phosphinosuccinic acid adduct, the phosphinosuccinic acid adduct of formula II constitutes between about 1-25 wt-% of the phosphinosuccinic acid adduct, the phosphinosuccinic acid adduct of formula III constitutes between about 10-60 wt-% of the phosphinosuccinic acid adduct, the phosphinosuccinic acid adduct of formula IV constitutes between about 20-70 wt-% of the phosphinosuccinic acid adduct.

13. The system of claim 10, wherein the phosphinosuccinic acid adduct constitutes between about 0.1-40 wt-% of the detergent composition, the alkalinity source constitutes between about 1-90 wt-% by weight of the detergent composition, and the detergent composition further comprises an additional nonionic surfactant.

14. The system of claim 10, wherein the system reduces or prevents hardness accumulation and/or soil redeposition on the surface, and provides a spot-free and film-free surface.

15. The system of claim 10, wherein the nonionic defoaming surfactant of the sanitizing rinse composition is an alkyl-ethylene oxide-propylene oxide copolymer surfactant and wherein the nonionic wetting surfactant of the sanitizing rinse composition is an alcohol ethoxylate according to the following structure R—O—(CH2CH2O) n-H, wherein R is a C1-C12 alkyl group and n is an integer in the range of 1 to 100.

16. The system of claim 15, wherein the alkyl-ethylene oxide-propylene oxide copolymer surfactant of the sanitizing rinse composition has a single hydroxyl functional group per molecule according to the following structure Alkyl-(EO)m-(PO)n-POH, wherein m is an integer in the range from 1 to 20 and n is an integer in the range from 1 to 20.

17. The system of claim 10, wherein the ratio of the nonionic defoaming surfactant(s) to the nonionic wetting surfactant(s) of the sanitizing rinse composition is from about 1.5:1 to about 10:1.

18. The system of claim 10, wherein the $C_1$-$C_{22}$ peroxycarboxylic acid of the sanitizing rinse composition is a $C_2$-$C_{20}$ peroxycarboxylic acid, and wherein the $C_1$-$C_{22}$ carboxylic acid of the sanitizing rinse composition is a $C_2$-$C_{20}$ carboxylic acid.

19. The system of claim 10, wherein the sanitizing rinse composition further comprises at least one additional agent selected from the group consisting of a hydrotrope or coupling agent, a solvent, a stabilizing agent and combinations thereof.

20. The system of claim 10, wherein the $C_1$-$C_{22}$ peroxycarboxylic acid comprises from about 1 wt-% to about 40 wt-%, the $C_1$-$C_{22}$ carboxylic acid comprises from about 1 wt-% to about 80 wt-%, the hydrogen peroxide comprises from about 1 wt-% to about 80 wt-%, and the nonionic surfactant/0 comprise from about 1 wt-% to about 50 wt-% of the sanitizing rinse composition.

* * * * *